US008494417B2

(12) United States Patent
Murase et al.

(10) Patent No.: US 8,494,417 B2
(45) Date of Patent: Jul. 23, 2013

(54) OPENING/CLOSING MEMBER, DEVELOPER SUPPLYING APPARATUS, AND IMAGE FORMING APPARATUS

(75) Inventors: Hirokazu Murase, Ebina (JP); Atsushi Funada, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 215 days.

(21) Appl. No.: 12/857,081

(22) Filed: Aug. 16, 2010

(65) Prior Publication Data

US 2011/0085825 A1 Apr. 14, 2011

(30) Foreign Application Priority Data

Oct. 13, 2009 (JP) ..... 2009-236111

(51) Int. Cl.
*G03G 15/08* (2006.01)

(52) U.S. Cl.
USPC ..... 399/262; 399/260

(58) Field of Classification Search
USPC ..... 399/260, 262
See application file for complete search history.

(56) References Cited

U.S. PATENT DOCUMENTS

| | | | | |
|---|---|---|---|---|
| 6,766,133 | B1 * | 7/2004 | Ban et al. | 399/258 |
| 7,352,975 | B2 | 4/2008 | Fujiwara et al. | |
| 7,574,163 | B2 * | 8/2009 | Sato | 399/260 |

FOREIGN PATENT DOCUMENTS

| | | | |
|---|---|---|---|
| JP | 10-213959 | A | 8/1998 |
| JP | 11-143190 | A | 5/1999 |
| JP | 2000-275946 | A | 10/2000 |
| JP | 2003-066705 | A | 3/2003 |
| JP | 2003-114568 | A | 4/2003 |
| JP | 2003-295591 | A | 10/2003 |
| JP | 2004-126407 | A | 4/2004 |
| JP | 2006-215239 | A | 8/2006 |
| JP | 3952705 | B2 | 5/2007 |

* cited by examiner

*Primary Examiner* — G. M. Hyder
(74) *Attorney, Agent, or Firm* — Sughrue Mion, PLLC

(57) ABSTRACT

An opening/closing member is movable between an open position in which a passage opening through which developer passes is open and a closed position in which the passage opening is closed. The opening/closing member includes a protrusion that protrudes toward an edge of the passage opening with respect to a scrape limiting portion, the protrusion being disposed on each of two sides with respect to a direction that is perpendicular to directions of movement between the open position and the closed position. A front end of the opening/closing member in a closing direction from the open position to the closed position is disposed so as to be separated from a surface of the edge of the passage opening.

16 Claims, 32 Drawing Sheets

Kk
Kk1
Kk2
Kk3
Kk4
Kk4a
6
6a
7
9
12
12c
12e
12f
12g
RT1
RT2
RTk
X
Y
Z
(−X)
(−Y)
(−Z)

32
48
21
51
61
44
77
Kk
46, 47
53a
53
53b
63b
72a
72
73
81
X
(-X)
Y
(-Y)
Z
(-Z)

OPENING/CLOSING MEMBER, DEVELOPER SUPPLYING APPARATUS, AND IMAGE FORMING APPARATUS

CROSS-REFERENCE TO RELATED APPLICATIONS

This application is based on and claims priority under 35 USC 119 from Japanese Patent Application No. 2009-236111 filed Oct. 13, 2009.

BACKGROUND

The present invention relates to an opening/closing member, a developer supplying apparatus, and an image forming apparatus.

SUMMARY

According to an aspect of the invention, there is provided an opening/closing member that is movable between an open position in which a passage opening through which developer passes is open and a closed position in which the passage opening is closed, the opening/closing member including a protrusion that protrudes toward an edge of the passage opening with respect to a scrape limiting portion, the protrusion being disposed on each of two sides with respect to a direction that is perpendicular to directions of movement between the open position and the closed position, wherein a front end of the opening/closing member in a closing direction from the open position to the closed position is disposed so as to be separated from a surface of the edge of the passage opening.

BRIEF DESCRIPTION OF THE DRAWINGS

Exemplary embodiments of the present invention will be described in detail based on the following figures, wherein:

FIGS. 9A and 9B illustrate an inlet portion, in which

FIG. 9A illustrates a state in which the toner cartridge is in a mounted position, and FIG. 9B illustrates a state in which the toner cartridge is removed;

FIGS. 10A and 10B are cross-sectional views of a holder base and the toner cartridge according to the first example, in which FIG. 10A illustrates a state in which the toner cartridge is in a removable position, FIG. 10B is a partial view of a front end portion of the body shutter, and FIG. 100 illustrates a state in which the toner cartridge is in the mounted position;

FIGS. 12A and 12B are partial views of a pull-out body according to the first example, in which FIG. 12A is a partial view viewed from the direction of arrow XIIA of FIG. 4, and FIG. 12B is a sectional view taken along line XIIB-XIIB of FIG. 6;

FIGS. 15A and 15B are partial views of a tilt holder according to the first example, in which FIG. 15A is a partial view of a front portion of the tilt holder when the tilt holder is in the insertable position illustrated in FIG. 4, and FIG. 15B is a sectional view taken along line XVB-XVB of FIG. 15A;

FIGS. 26A and 26B illustrate the rotation limiting mechanism according to the first example, in which FIG. 26A is an exploded view, and FIG. 26B is a view in the direction of arrow XXVIB of FIG. 26A;

FIGS. 27A to 27C are views in the direction of arrow XXVII of FIG. 25, in which FIG. 27A illustrates a state in which the rotation liming member is in a limiting position and in a movement limiting position, FIG. 27B illustrates a state in which the rotation liming member is in the limiting position and in a movement limitation released position, and FIG. 27C illustrates a state in which the rotation liming member is in an allowance position;

FIGS. 30A to 30C illustrate the operation of mounting the toner cartridge on the holder, in which FIG. 30A illustrates a state in which the toner cartridge is made to contact the front cover from below, FIG. 30B illustrates a state in which the toner cartridge is being tilted and pushed upward from the state illustrated in FIG. 30A, and FIG. 30C illustrate a state in which the toner cartridge has been mounted on the holder;

DETAILED DESCRIPTION

Figure 1:
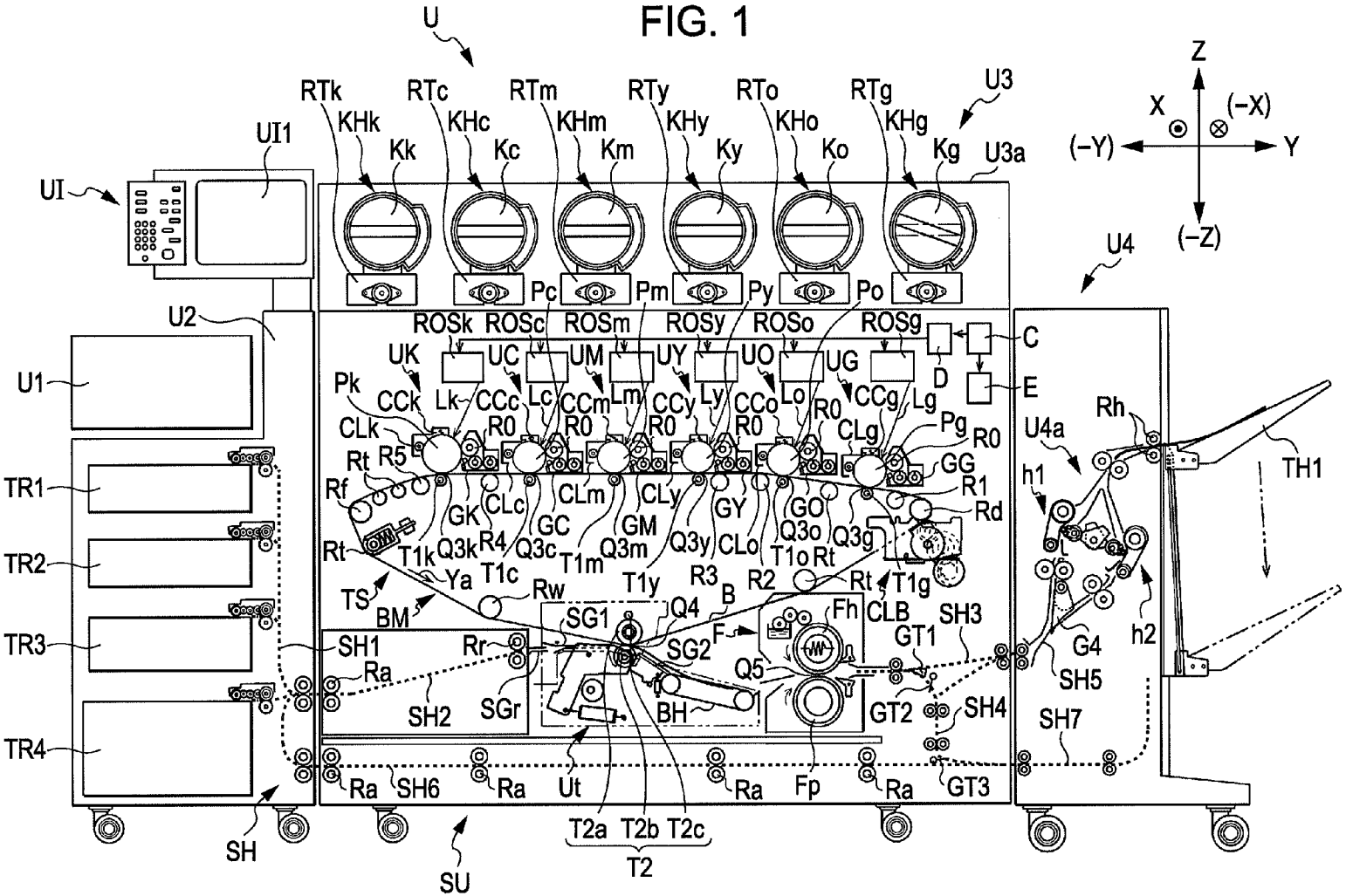
FIG. 1 is an overall view of an image forming apparatus according to a first example of the present invention.

Hereinafter, examples of an exemplary embodiment of the present invention (hereinafter referred to as "examples") will be described with reference to the drawings. However, the present invention is not limited thereto.

For ease of understanding, in the drawings, the X axis extends in the front-rear directions, the Y axis extends in the left-right directions, and the Z axis extends in the up-down directions. The directions indicated by arrows X, −X, Y, −Y, Z, and −Z respectively correspond to forward, rearward, rightward, leftward, upward, and downward directions (in other words, front, rear, right, left, up, and down).

In the drawings, a small circle with a dot inside represents an arrow extending from the back side to the front side of the paper, and a small circle with a cross inside represents an arrow extending from the front side to the back side of the paper.

For ease of understanding, members that are not necessary for description are omitted from the drawings.

FIRST EXAMPLE

FIG. 1 is an overall view of an image forming apparatus according to a first example of the present invention.

Referring to FIG. 1, an image forming apparatus U according to the first example includes a user interface UI, an image input unit U1, a sheet feeding unit U2, an image forming apparatus body U3, and a sheet handling unit U4. The user interface UI is an example of an operation section. The image input unit U1 is an example of an image information input unit.

The user interface UI includes a copy start key, a copy quantity key, a copy quantity key, an input button, and a display U11. The copy start key is an example of an image formation start button. The copy quantity key is an example of an image formation quantity setting button. The input button, such as a numeric keypad, is an example of a number input button.

The image input unit U1 includes an auto document feeding unit and an image scanner or the like, which is an example of an image reading unit. Referring to FIG. 1, the image input unit U1 reads an image of a document (not shown), converts the image to image information, and inputs the image information to the image forming apparatus body U3.

The sheet feeding unit U2 removably supports sheet feed trays TR1 to TR4, which are examples of sheet feeders. Each of the sheet feed trays TR1 to TR4 contains recording sheets S, which are examples of final transfer bodies or media. The recording sheets S are fed out from the sheet feed trays TR1 to TR4, and transported along a sheet feed path SH1 and the like to the image forming apparatus body U3.

Referring to FIG. 1, the image forming apparatus body U3 includes an image recording unit, a toner dispenser unit U3*a*, a sheet transport path SH2, a sheet discharge path SH3, a sheet reversal path SH4, and a sheet circulation path SH6. The image recording unit records an image on the recording sheet S transported from the sheet feeding unit U2. The toner dispenser unit U3*a* is an example of a developer supplying apparatus.

The image forming apparatus body U3 further includes a controller C, a laser driving circuit D controlled by the controller C, and a power supply circuit E controlled by the controller C. The laser driving circuit D is an example of a latent image writing unit driving circuit. The laser driving circuit D outputs laser driving signals in accordance with image information corresponding to green (G), orange (O), yellow (Y), magenta (M), cyan (C), and black (K), which has been input from the image input unit U1, to latent image forming units ROSg, ROSo, ROSy, ROSm, ROSc, and ROSk for respective colors with predetermined timings.

Below the latent image forming units ROSg to ROSk, image carrier units UG, UO, UY, UM, UC, and UK for respective colors and developing units GG, GO, GY, GM, GC, and GK for respective colors, which are examples developing mechanisms for respective colors, are removably attached.

The black image carrier unit UK includes a photoconductor drum Pk, a charger CCk, and a cleaner CLk. The photoconductor drum Pk is an example of an image carrier body, and a cleaner CLk is an example of an image carrier cleaning mechanism. A developing roller R0 is disposed adjacent to the right side of the photoconductor drum Pk. The developing roller R0 is an example of a developing member. The other image carrier units UG to UC respectively include photoconductor drums Pg, Po, Py, Pm, and Pc, chargers CCg, CCo, CCy, CCm, and CCc, and cleaners CLg, CLo, CLy, CLm, and CLc. Developing rollers R0 of the developing units GG to GC for respective colors are respectively disposed adjacent to the right sides of the photoconductor drums Pg to Pc. The developing rollers R0 are examples of a developing member.

In the first example, the black photoconductor drum Pk, which is frequently used and whose surface is easily abraded, has a larger diameter than photoconductor drums Pg to Pc for other colors, so that the black photoconductor drum Pk may resist high-speed rotation and have a long life.

The image carrier units UY to UO and the developing units GY to GO constitute visible image forming members (UG+GG), (UO+GO), (UY+GY), (UM+GM), (UC+GC), and (UK+GK).

Referring to FIG. 1, the chargers CCg to CCk uniformly charges the photoconductor drums Pg to Pk, respectively, and the latent image forming units ROSg to ROS emit laser beams Lg, Lo, Ly, Lm, Lc, and Lk, which are examples of latent image writing light beams, so as to form electrostatic latent images on the surfaces of the photoconductor drums Pg to Pk. The developing units GG to GK respectively develop the electrostatic latent images formed on the surfaces of the photoconductor drums Pg to Pk so as to form toner images of green (G), orange (O), yellow (Y), magenta (M), cyan (C), and black (K), which are examples of visible images.

The first transfer rollers T1*g*, T1*o*, T1*y*, T1*m*, T1*c*, and T1*k*, which are examples of first transfer members, successively transfers the toner images on the photoconductor drums Pg to Pk in an overlapping manner to an intermediate transfer belt B, which is an example of an intermediate transfer body, in first transfer regions Q3*g*, Q3*o*, Q3*y*, Q3*m*, Q3*c*, and Q3*k*, so as to form a polychromatic image (color image) on the intermediate transfer belt B. The color image formed on the intermediate transfer belt B is transported to a second transfer region Q4.

When there is only black image data, only the photoconductor drum Pk and the developing unit GK are used to form a black toner image. When forming an image of four colors including Y, M, C, and K, or forming an image of two or three colors in accordance with setting by a user, a corresponding set of photoconductor drums Pg to Pk and the developing units GG to GK is used.

After the first transfer is finished, cleaners CLg to CLk for the photoconductor drums respectively clean residual toner on the surfaces of the photoconductor drums Pg to Pk, and the chargers CCg to CCk recharge the photoconductor drums Pg to Pk.

As the developer is consumed by the developing units GG to GK, developer is transported from toner cartridges Kg, Ko, Ky, Km, Kc, and Kk mounted in the toner dispenser unit U3*a* and supplied to the developing units GG to Gk. The toner cartridges Kg, Ko, Ky, Km, Kc, and Kk are examples of a developer container vessel and also examples of a removable unit.

Figure 2:
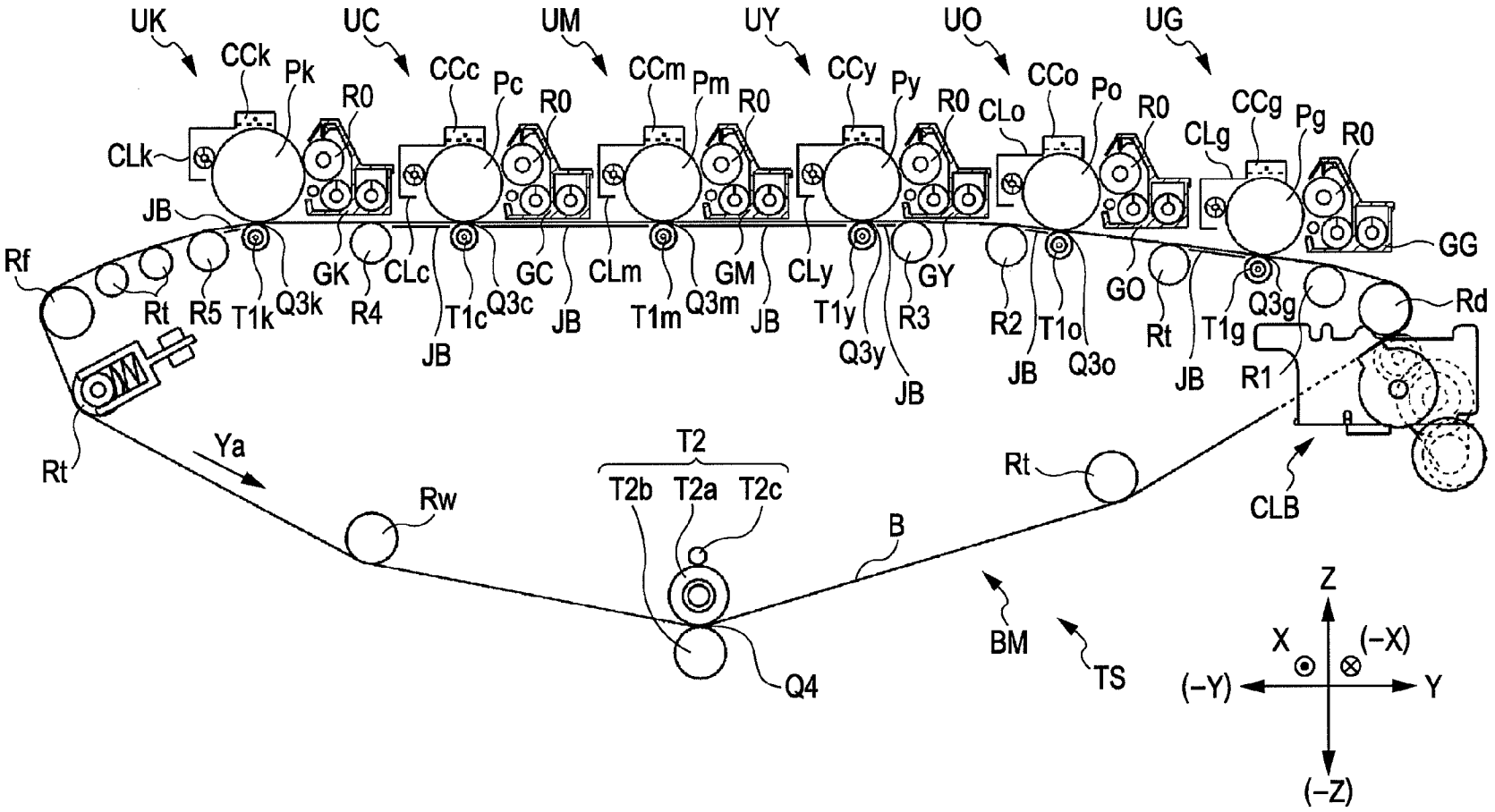
FIG. 2 is an overall view of a belt module according to the first example of the present invention.

FIG. 2 is an overall view of a belt module of the first example of the present invention.

Referring to FIGS. 1 and 2, a belt module BM is disposed below the photoconductor drums Pg to Pk. The belt module BM is an example of an intermediate transfer unit. The belt module BM is supported so as to be movable between an elevated position in which the belt module BM contacts the lower surfaces of the photoconductor drums Pg to Pk and a lowered position in which the belt module Bm is separated from the photoconductor drums Pg to Pk.

The belt module BM includes the intermediate transfer belt B. A belt driving roller Rd supports the intermediate transfer belt B from the back side and rotates the intermediate transfer belt B in the direction of an arrow Ya. The belt driving roller Rd is an example of an intermediate transfer body driving member. A tension roller Rt applies tension to the intermediate transfer belt B. The tension roller Rt is an example of a tension applying member. The back side of the intermediate transfer belt B is supported by a walking roller Rw, idler rollers Rf, and a backup roller T2*a*. The walking roller Rw, which prevents meandering of the intermediate transfer belt B, is an example of a meandering prevention member. The idler rollers Rf are examples of a driven member, and the backup roller T2*a* is an example of a second transfer counter member.

In the first example, a first retract roller R1 is disposed upstream of the first transfer roller T1*g* for the G color with respect to the direction of the arrow Ya. The first retract roller R1 is supported so as to be movable in contact/separation directions, which are perpendicular to the direction of the arrow Ya and in which the intermediate transfer belt B is moved to be in contact with or separated from the photoconductor drum Pg. The first retract roller R1 is an example of a connecting/disconnecting intermediate transfer body support member. A second retract roller R2 and a third retract roller R3 are adjacently disposed downstream of the first transfer roller T1*o* for color O and upstream of the first transfer roller T1*y* for color Y with respect to the direction of the arrow Ya. The second and third retract rollers R2 and R3, which are examples of the connecting/disconnecting intermediate transfer body support member, have the same structure as the first retract roller R1. A fourth retract roller R4 is disposed downstream of the first transfer roller T1*c* for color C and upstream of the first transfer roller T1*k* for color K with respect to the direction of the arrow Ya. The fourth retract roller R4, which is an example of the connecting/disconnecting intermediate transfer body support member, has the same structure as the first retract roller R1. A fifth retract roller R5 is disposed downstream of the first transfer roller T1*k* for color K with respect to the direction of the arrow Ya. The fifth retract roller R5, which is an example of the connecting/disconnecting intermediate transfer body support member, has the same structure as the first retract roller R1.

An electrostatic eliminating plate JB having a plate-like shape is disposed downstream of each of the first transfer rollers T1*g* and T1*k* with respect to the direction of the arrow Ya. The electrostatic eliminating plates JB eliminates an electric charge on the back surface of the intermediate transfer belt B. The electrostatic eliminating plates JB is an example of an electrostatic eliminating member. In the first example, the electrostatic eliminating plate JB is disposed so as not to contact the intermediate transfer belt B. For example, the electrostatic eliminating plate JB is separated from the back surface of the intermediate transfer belt B by 2 mm.

The rollers Rd, Rt, Rw, Rf, T2*a*, and R1 to R5 constitute belt supporting rollers Rd, Rt, Rw, Rf, T2*a*, and R1 to R5 that support the back surface the intermediate transfer belt B, which are examples of an intermediate transfer body support member.

The intermediate transfer belt B, the belt supporting rollers Rd, Rt, Rw, Rf, T2*a*, and R1 to R5, the first transfer rollers T1*g* to T1*k*, the electrostatic eliminating plate JB, and the like constitute the belt module BM according to the first example.

A second transfer unit Ut is disposed below the backup roller T2*a*. In the second transfer unit Ut, a second transfer roller T2*b* is disposed so that the second transfer roller T2*b* may be in contact with or separated from the backup roller T2*a* with the intermediate transfer belt B therebetween. The second transfer roller T2*b* is an example of a second transfer member. A second transfer region Q4 is a region in which the second transfer roller T2*b* is pressed against the intermediate transfer belt B. A contact roller T2*c*, which is an example of a voltage applying contact member, contacts the backup roller T2*a*. The rollers T2*a* to T2*c* constitute a second transfer mechanism T2, which is an example of a final transfer member.

A power supply circuit, which is controlled by the controller C, supplies a second transfer voltage to the contact roller T2*c*. The transfer voltage has the same polarity as the charged toner.

A sheet transport path SH2 is disposed below the belt module BM. The recording sheet S is fed along the sheet feed path SH1 of the sheet feeding unit U2 to the sheet transport path SH2. The recording sheet S is transported through a medium guiding member SGr and a pre-transfer medium guiding member SG1 to a second transfer region Q4 at the same time as a registration roller Rr transports the toner images to the second transfer region Q4. The registration roller Rr is an example of feed timing adjusting member.

The medium guiding member SGr and the registration roller Rr are fixedly supported on the image forming apparatus body U3.

The second transfer mechanism T2 transfers the toner images on the intermediate transfer belt B to the recording sheet S when the recording sheet S passes through the second transfer region Q4. When forming a full-color image, the toner images, which have been first transferred to the surface of the intermediate transfer belt B in an overlapping manner, are second transferred to the recording sheet S simultaneously.

After the second transfer is finished, a belt cleaner CLB, which is an example of a intermediate transfer body cleaner, cleans the intermediate transfer belt B. The second transfer roller T2*b* and the belt cleaner CLB are supported in such a way that the second transfer roller T2*b* and the belt cleaner CLB may be in contact with or separated from the intermediate transfer belt B.

A transfer device TS, which includes the belt module BM, the second transfer mechanism T2, and the belt cleaner CLB, transfers the images on the surface of the photoconductor drums Py to Po to the recording sheet S.

The recording sheet S, on which the toner images have been second transferred, is transported through a post-transfer medium guiding member SG2 and a sheet transfer belt BH to a fixing unit F. The sheet transfer belt BH is an example of a pre-fixing medium transport member. The fixing unit F includes a heating roller Fh and a pressure roller Fp. The heating roller Fh is an example of a heat fixing member, and the pressure roller Fp is an example of a pressure fixing member. A fixing region Q5 is a region in which the heating roller Fh is pressed against the pressure roller Fp.

The fixing unit F thermally fixes the toner images on the recording sheet S when the recording sheet passes through the fixing region Q5. A transport path switching member GT1 is disposed downstream of the fixing unit F. The transport path switching member GT1 selectively switches the path of the recording sheet S, which has been transported along the sheet transport path SH2 and thermally fixed in the fixing region Q5, to the sheet discharge path SH3 or to the sheet reversal path SH4 of the sheet handling unit U4. The recording sheet S that is transported to the sheet discharge path SH3 is transported to the sheet transport path SH5 of the sheet handling unit U4.

A curl correction unit U4*a* is disposed in the middle of the sheet transport path SH5. A switching gate G4, which is an example of a transport path switching member, is disposed in the sheet transport path SH5. The switching gate G4 selectively transports the recording sheet S, which has been transported along the sheet transport path SH3 of the image forming apparatus body U3, to a first curl correction member h1 or a second curl correction member h2 in accordance with the direction of a curl. The first curl correction member h1 or the second curl correction member h2 corrects the curl of the recording sheet S that passes therethrough. The recording sheet S, whose curl has been corrected, is transported by a discharge roller Rh and discharged to a discharge tray TH1 of the sheet handling unit U4 in a face-up state, i.e. with the image-fixed surface of the recording sheet S on the front side. The discharge roller Rh is an example of a discharge member, and a discharge tray TH1 is an example of a discharge unit.

The recording sheet S, which has been transported by the transport path switching member GT1 to the sheet reversal path SH4 of image forming apparatus body U3, pushes and passes through a mylar gate GT2, which is a transport direction limiting member made of an elastic film, and is transported to the sheet reversal path SH4 of the image forming apparatus body U3.

The sheet circulation path SH6 and the sheet reversal path SH7 are connected to a downstream end of the sheet reversal path SH4 of the image forming apparatus body U3, and a mylar gate GT3 is disposed in the connection portion. The recording sheet S, which has passed though the switching gate GT1 and the sheet transport path SH4, passes through the mylar gate GT3 and is transported to the sheet reversal path SH7 of the sheet handling unit U4. When performing double-sided printing, the recording sheet S, which has been transported along the sheet reversal path SH4, passes through the mylar gate GT3, and is transported to the sheet reversal path SH7. Subsequently, when the recording sheet S is transported in a reverse direction (switched back), the mylar gate GT3 restricts the transport direction, and the recording sheet S that has been switched back is transported to the sheet circulation path SH6. The recording sheet S, which has been transported to the sheet circulation path SH6, is transported along the sheet feed path SH1 to the second transfer region Q4.

The recording sheet S that is transported along the sheet reversal path SH4 is switched back after the rear end of the recording sheet S has passed through the mylar gate GT2 and before the rear end passes through the mylar gate GT3. The mylar gate GT2 restricts the transport direction of the recording sheet S, whereby the recording sheet S is transported to the sheet transport path SH5 in a reverse state. The curl correction member U4*a* corrects the curl of the recording sheet S, which has been reversed, and the recording sheet S is discharged to the sheet discharge tray TH1 of the sheet handling unit U4 in a face-down state, i.e., with the image-fixed surface of the recording sheet S on the back side.

The elements represented by numerals SH1 to SH7 constitute a sheet transport path SH. The elements represented by numerals SH, Ra, Rr, Rh, SGr, SG1, SG2, BH, and GT1 to GT3 constitute a sheet transport unit SU.

Toner Dispenser Unit U3*a*

Referring to FIG. 1, in the first example, the toner dispenser unit U3*a* includes cartridge holders KHg, KHo, KHy, KHm, KHc, and KHk in which the toner cartridges Kg to Kk for the colors G, O, Y, M, C, and K are installed, and reserve tanks RTg, RTo, RTy, RTm, RTc, and RTk in which developer supplied from the toner cartridges Kg to Kk are temporarily reserved and agitated, which are examples of a developer reserve vessel. As the developing units GG to GK consume developer, the developer that has been agitated in the tanks RTg to RTk is transported by transport members (not shown).

Next, the cartridge holders KHg to KHk of the first example, which are examples of a removable unit holding unit, will be described. Because the cartridge holders KHg to KHk have the same structure, only the cartridge holder KHk for K color will be described, and description of the cartridge holders KHg to KHc for other colors will be omitted.

Figure 3:
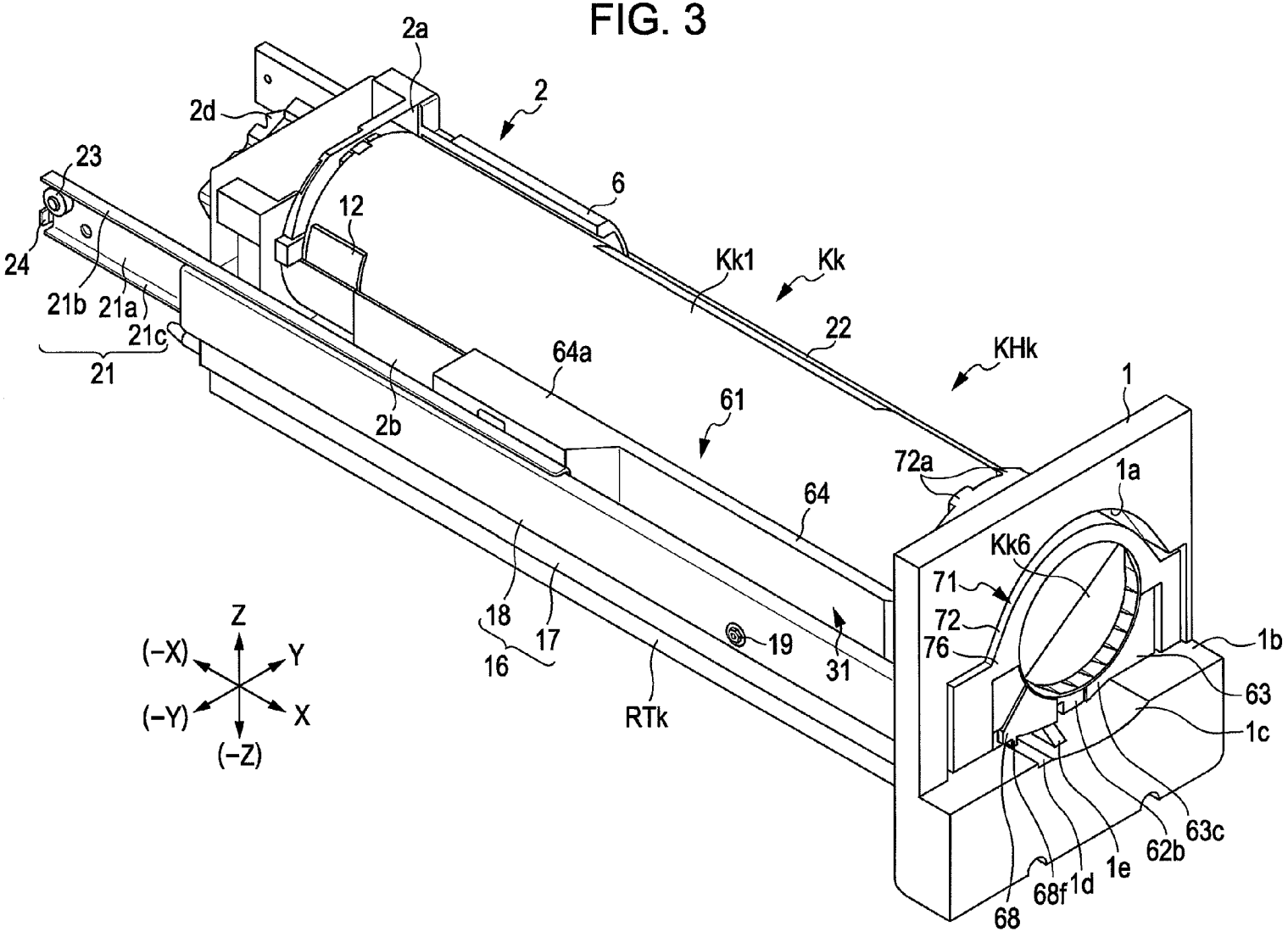
FIG. 3 is a perspective view of a toner dispenser unit according to the first example.

FIG. 3 is a perspective view of a toner dispenser unit according to the first example.

Figure 4:
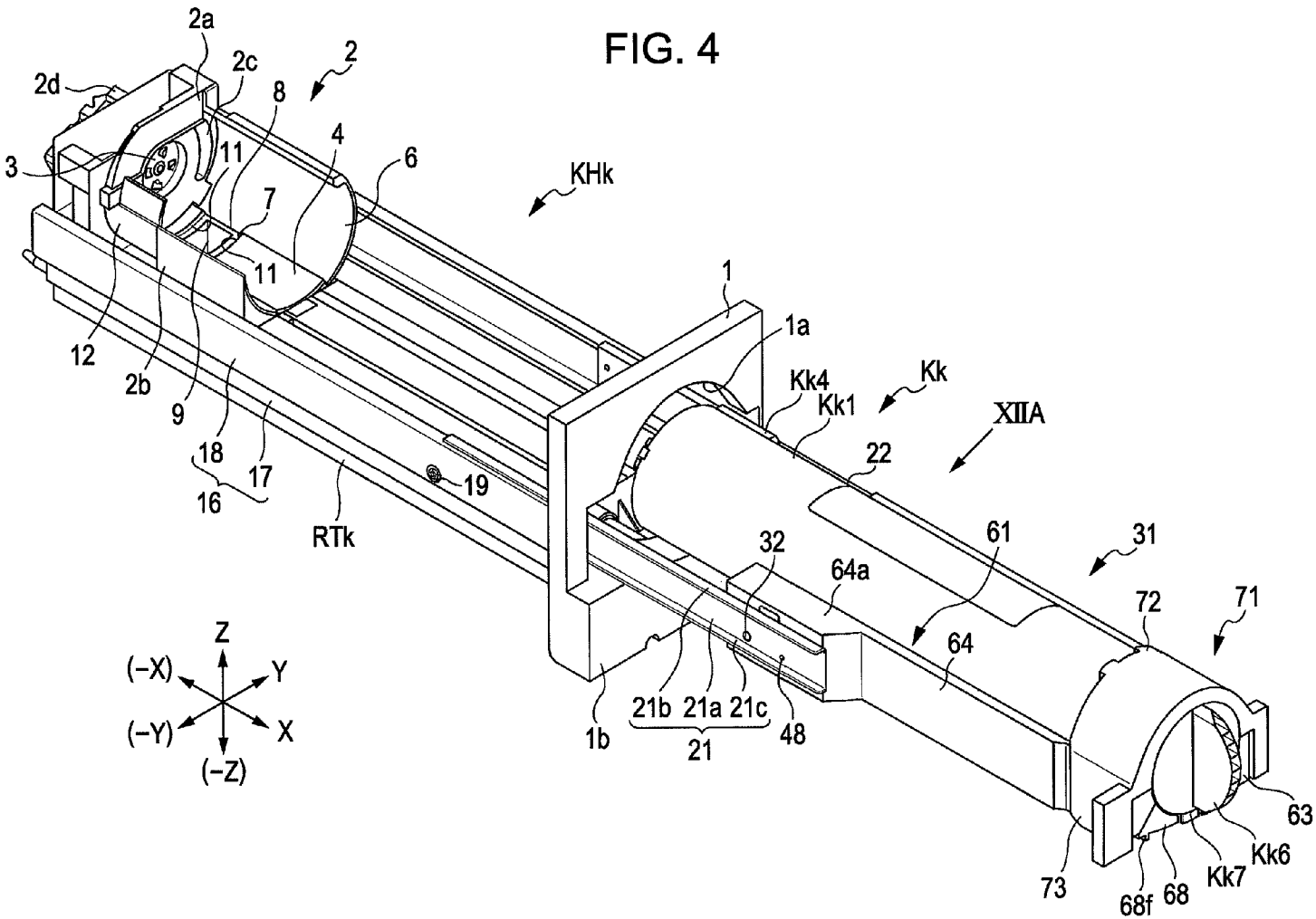
FIG. 4 is a perspective view of the toner dispenser unit according to the first example when the toner dispenser unit is in a pulled-out position in which a tilt holder has been pulled out from the state illustrated in FIG. 3.

FIG. 4 is a perspective view of the toner dispenser unit according to the first example when the toner dispenser unit is in a pulled-out position in which a tilt holder has been pulled out from the state illustrated in FIG. 3.

Figure 5:
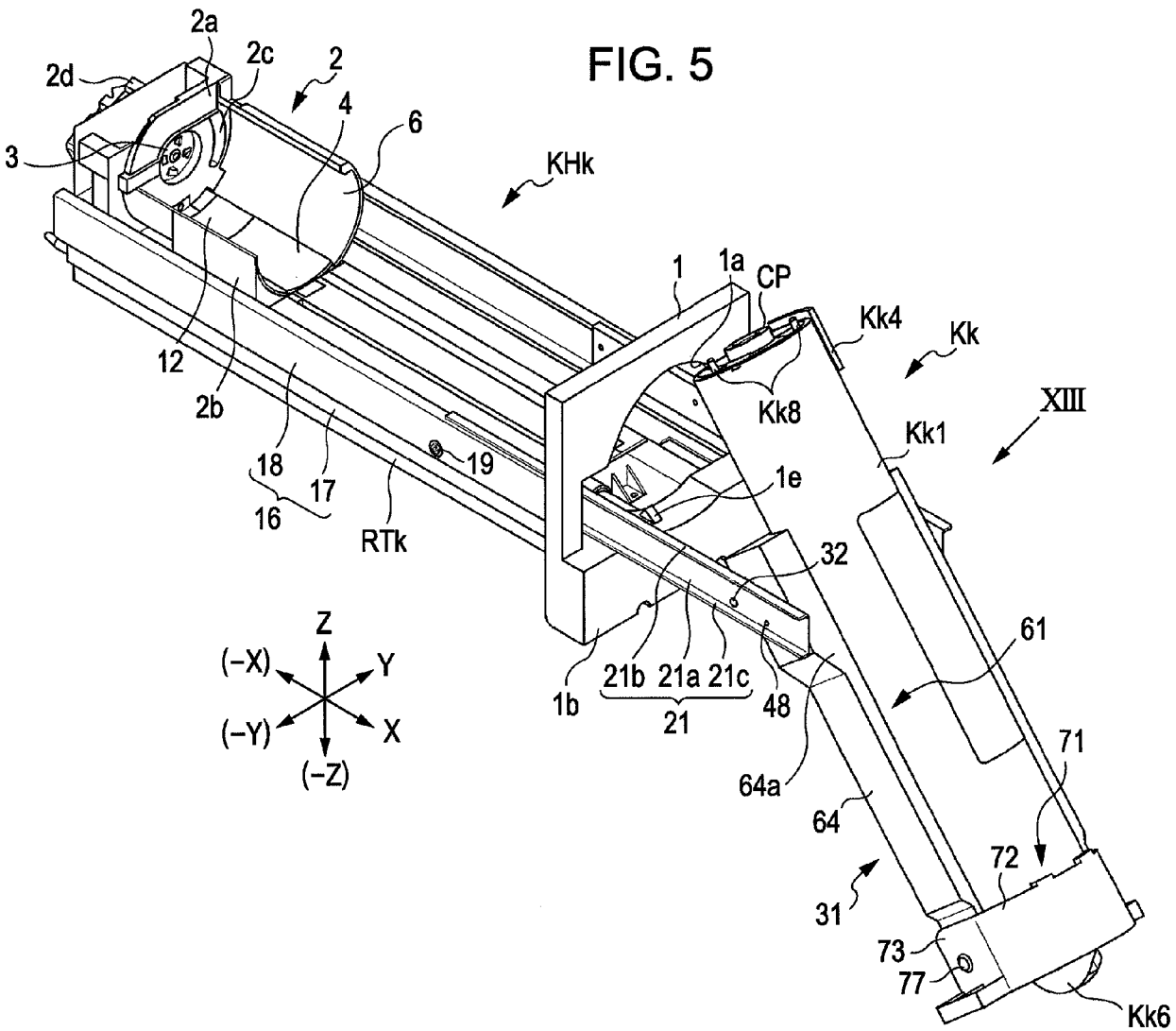
FIG. 5 is a perspective view of the toner dispenser unit according to the first example when the tilt holder has been moved to a tilt position from the state illustrated in FIG. 4.

FIG. 5 is a perspective view of the toner dispenser unit according to the first example when the tilt holder has been moved to a tilt position from the state illustrated in FIG. 4.

Figure 6:
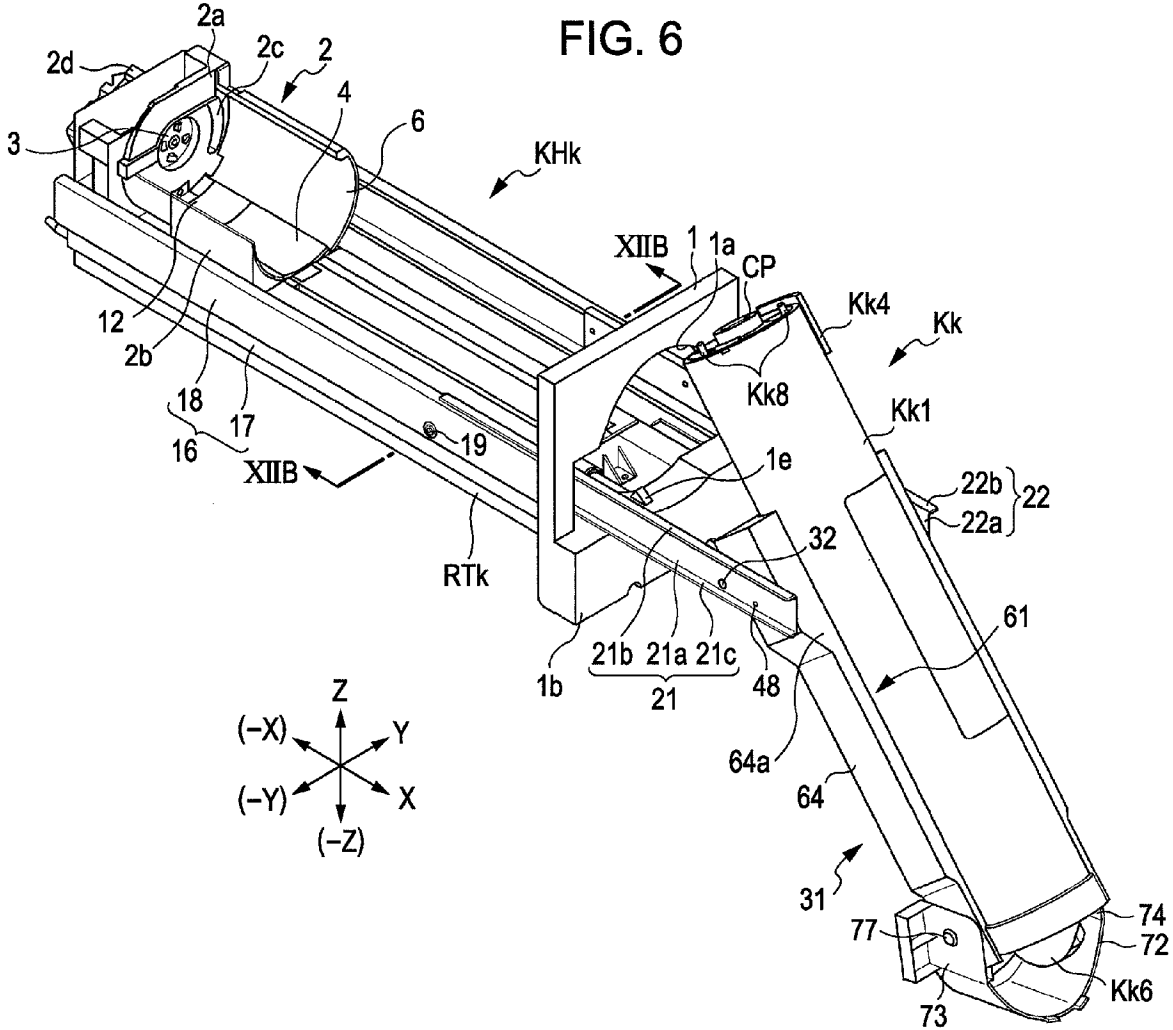
FIG. 6 is a perspective view of the toner dispenser unit according to the first example when a front end cover has been moved to a front end open position from the state illustrated in FIG. 5.

FIG. 6 is a perspective view of the toner dispenser unit according to the first example when a front end cover has been moved to a front end open position from the state illustrated in FIG. 5.

Figure 7:
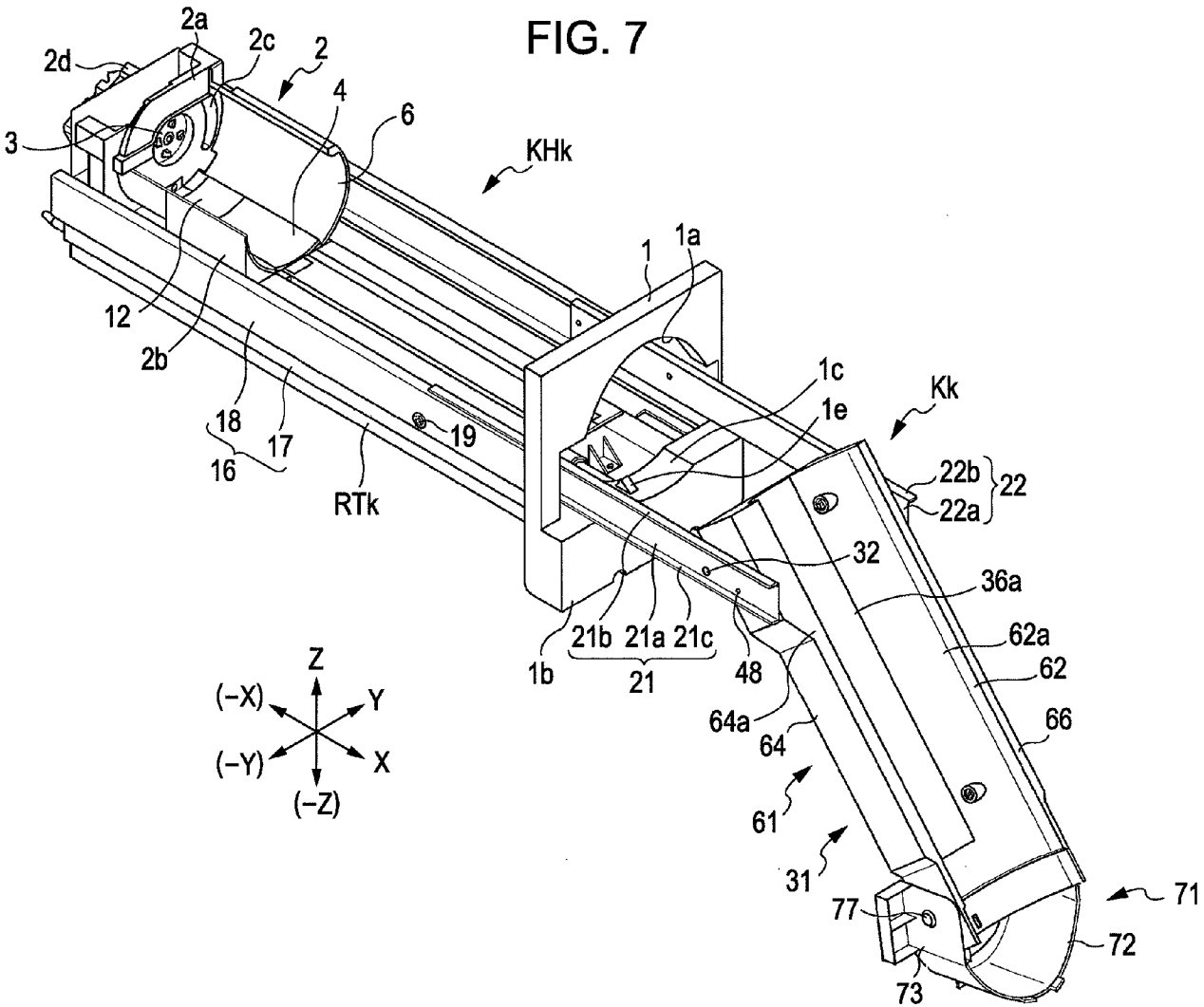
FIG. 7 is a perspective view of the toner dispenser unit according to the first example when a toner cartridge has been removed from the state illustrated in FIG. 6.

FIG. 7 is a perspective view of the toner dispenser unit according to the first example when a toner cartridge has been removed from the state illustrated in FIG. 6.

In reality, a body-side shutter has been moved to an outlet closed position in the state of FIG. 4. However, for ease of understanding, the body-side shutter is in an outlet open position in FIG. 4.

Referring to FIGS. 1, and 3 to 7, the cartridge holder KHk for K color, includes a front frame 1 fixedly supported by the image forming apparatus body U3, which is an example of a pull-out supporting member and an example of a front-end frame body, and a holder base 2 disposed at a rear end of the reserve tank RTk, which is an example of a fixing member. Referring to FIGS. 3 to 7, an opening 1*a* having a circular shape is formed in the front frame 1, so that the toner cartridge Kk may be inserted into and removed from the opening 1*a*. Referring to FIGS. 3, and 5 to 7, a lower frame 1*b* is formed below the front frame 1 so as to protrude forward. An insertion surface 1*c*, which is recessed in an arc-shape, is formed in the upper surface of the lower frame 1*b* so as to correspond to the opening 1*a*. In the left end portion of the insertion surface 1*c*, a lock release groove 1*d*, which is an example of a movement allowing member, is formed so as to extend from the front to the rear. An inclined surface 1*e* inclined upward from the front end thereof, which is an example of a limit release member, is formed on the right side of the lock release groove 1*d*.

Referring to FIGS. 4 to 7, the holder base 2 includes a rear end wall 2*a*, which has a plate-shape and is disposed at the rear end thereof, an a cylindrical wall 2*b*, which has a semi-cylindrical shape and extending forward from the rear end wall 2*a*.

Figure 8:
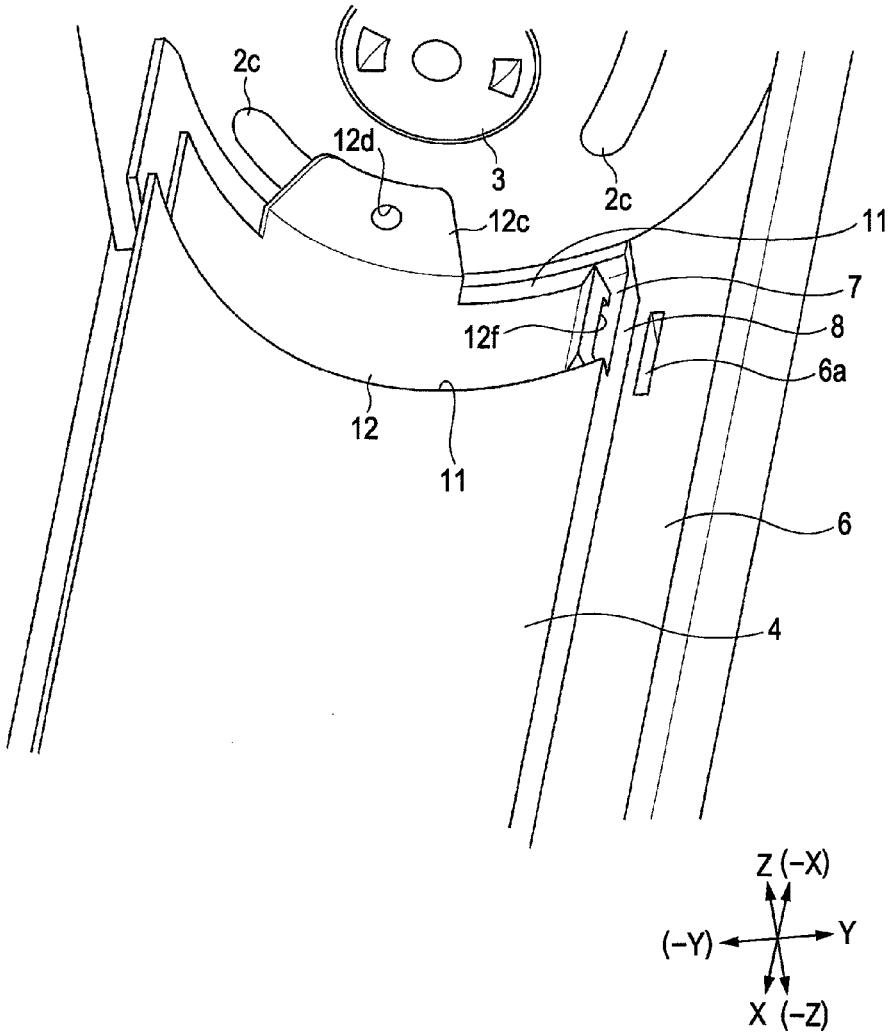
FIG. 8 is a partial view of a holder base according to the first example.

FIG. 8 is a partial view of the holder base of the first example.

Referring to FIGS. 4 to 8, a hard key insertion groove 2*c* is formed as an arc-shaped groove in the rear end wall 2*a*. A hard key Kk8 protrudes rearward from the rear end of the toner cartridge Kk, and the hard key Kk8 may be fitted into the hard key insertion groove 2*c*. The hard key insertion groove 2*c* is an example of a mismount preventing portion on the body side, and the hard key Kk8 is an example of a mismount preventing portion on the removable unit side. Thus, when the toner cartridges Kg to Kk that contain developer are mounted on the developing units Gg to Gk corresponding to the color of the developer, the hard key Kk8 matches the hard key insertion groove 2*c* and may be fitted into the hard key insertion groove 2*c*. When the toner cartridge is mounted on a developing unit that does not correspond to the color of the developer, the positions of the hard key Kk8 and the hard key insertion groove 2*c* do not match, and the hard key Kk8 is not fitted into the hard key insertion groove 2*c*.

Figure 9B:
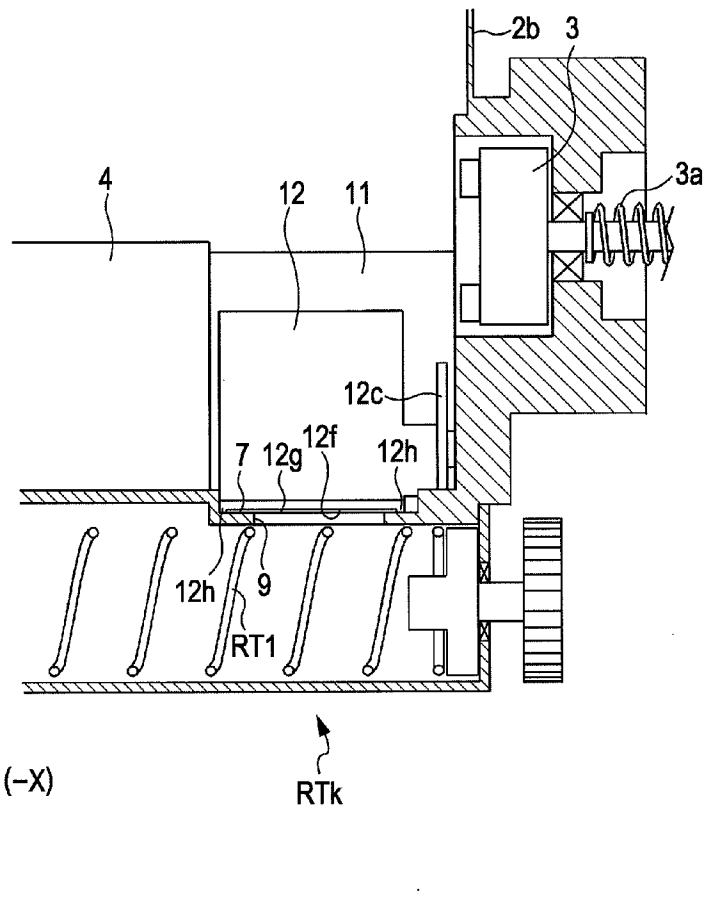
Figure 9A:
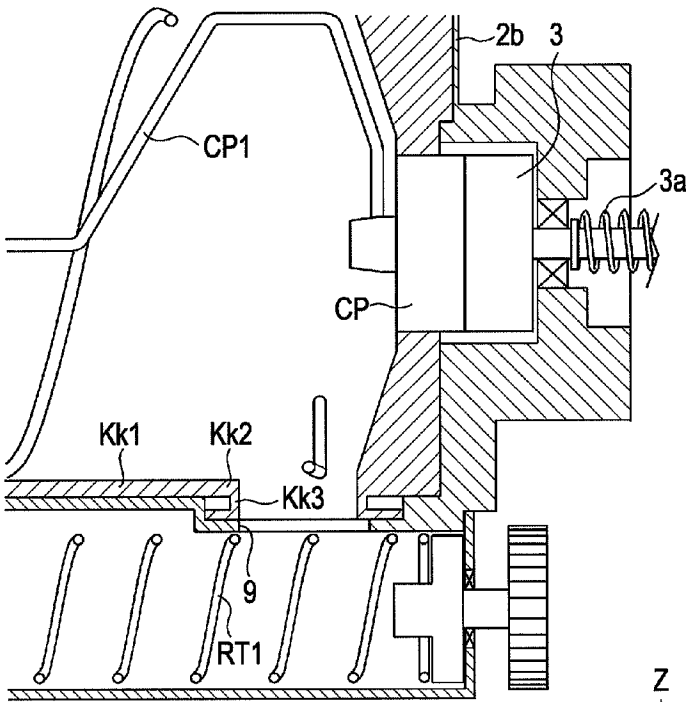

FIGS. 9A and 9B illustrate an inlet portion, in which FIG. 9A illustrates a state in which the toner cartridge is in a mounted position, and FIG. 9B illustrates a state in which the toner cartridge is removed.

Referring to FIGS. 4 to 9B, a coupling 3, to which a driving force is transmitted from a drive source 2*d*, is supported on the rear end wall 2*a*. The coupling 3 is an example of a drive transmitting member. The coupling 3 engages with a coupling CP illustrated in FIG. 5 located at the rear end of the toner cartridge Kk. The coupling CP is an example of a drive transmitted member. Referring to FIG. 9, a coupling spring 3*a* urges the coupling 3 on the body of the first example forward so that the coupling securely engages with the coupling CP of the toner cartridge Kk. The coupling spring 3*a* is an example of an urging member. As illustrated in FIGS. 9A and 9B, the coupling 3 is movably supported so as to be movable in the front-rear direction in a state in which the coupling 3 is retained by a retainer (not shown) so that the coupling 3 may not be disconnected.

Figures 10A, 10B, 10C:
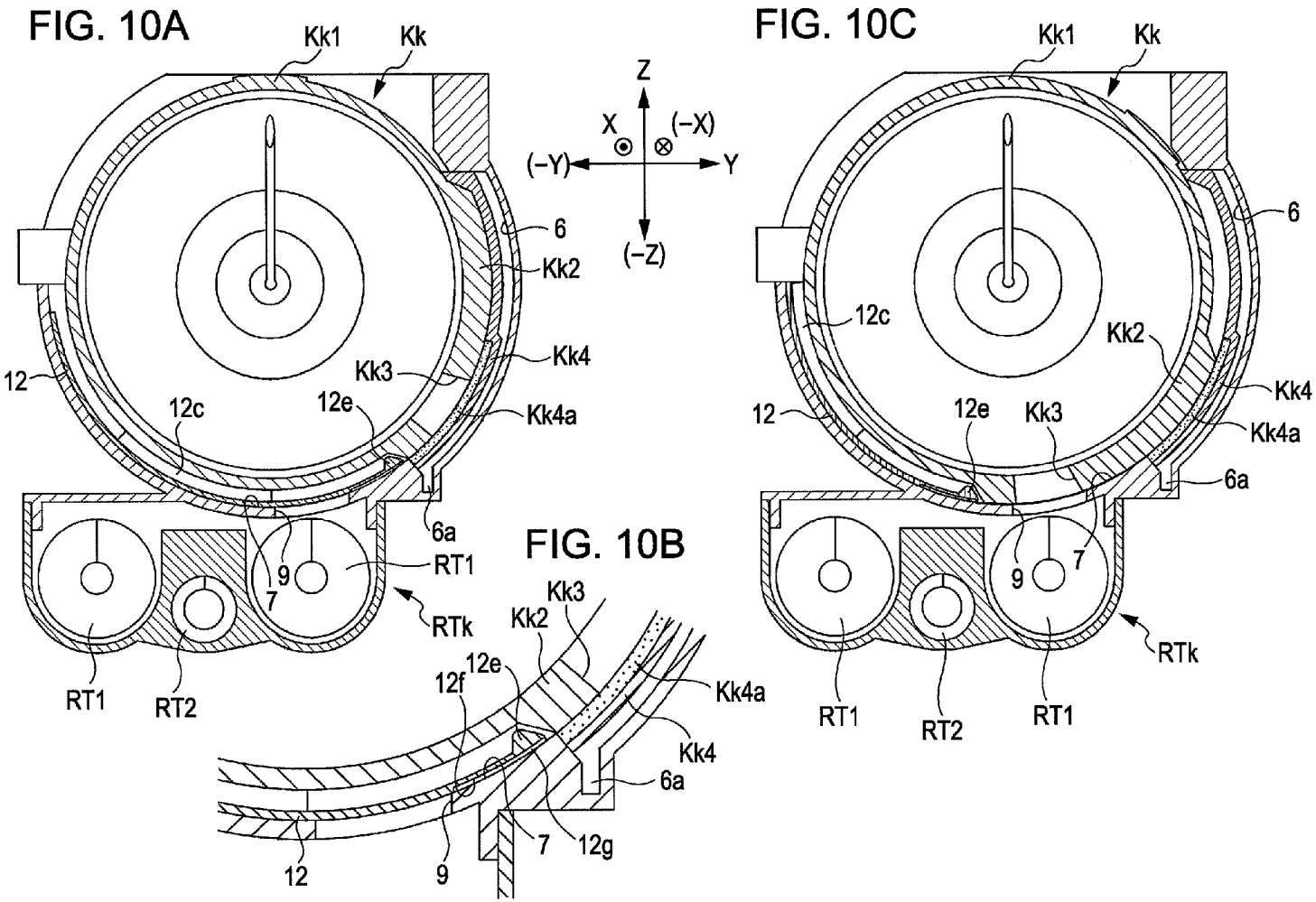

FIGS. 10A and 10B are cross-sectional views of a holder base and a toner cartridge of the first example, in which FIG. 10A illustrates a state in which the toner cartridge is in a removable position, FIG. 10B is a partial view of a front end portion of the body shutter, and FIG. 10C illustrates a state in which the toner cartridge is in the mounted position.

Referring to FIGS. 3 to 8, the cylindrical wall 2*b* of the holder base 2 includes an inner peripheral surface 4 having an arc-shape and extending leftward from the bottom and a shutter passage groove 6 formed in a right portion of the inner peripheral surface 4 and extending in the front-rear direction. The shutter passage groove is an example of an opening/closing member passage. Referring to FIGS. 9A to 100, at the rear end of the inner peripheral surface 4, an inlet forming portion 7 is formed so as to be recessed from the inner peripheral surface 4 having an arc-shape and so as to protrude from the shutter passage groove 6. The inlet forming portion 7 extends in the circumferential direction of the cylindrical wall 2*b*. A shutter pressing portion 8 is formed in a step portion between the inlet forming portion 7 and the shutter passage groove 6. The shutter pressing portion 8 is an example of an opening/closing member pressing portion, Referring to FIGS. 8 and 10B, a developer pocket 6*a* is formed in the shutter passage groove 6 below the shutter pressing portion 8. The developer pocket 6*a*, which is recessed and extends in the front-rear direction, is capable of containing developer. The developer pocket 6*a* is an example of a dropped developer container.

Referring to FIGS. 4, 9A and 9B, and 10A to 10C, an inlet 9, which is an example of a passage opening, is formed in the inlet forming portion 7. The inlet 9 is connected to a reserve tank RTk, which is disposed below the inlet 9. Body-side shutter guides 11, which are examples of a shielding member guiding portion, are formed on the front side and the rear side of the inlet 9. The body-side shutter guides 11 extend so as to form an arc-shape along the inner peripheral surface 4 of the cylindrical wall 2*b*. A body-side shutter 12, which has an arc-shape extending along the cylindrical wall 2*b*, is supported by the body-side shutter guides 11 so as to be movable along the inner peripheral surface of the cylindrical wall 2*b*. The body-side shutter is an example of an opening/closing member.

Figure 11:
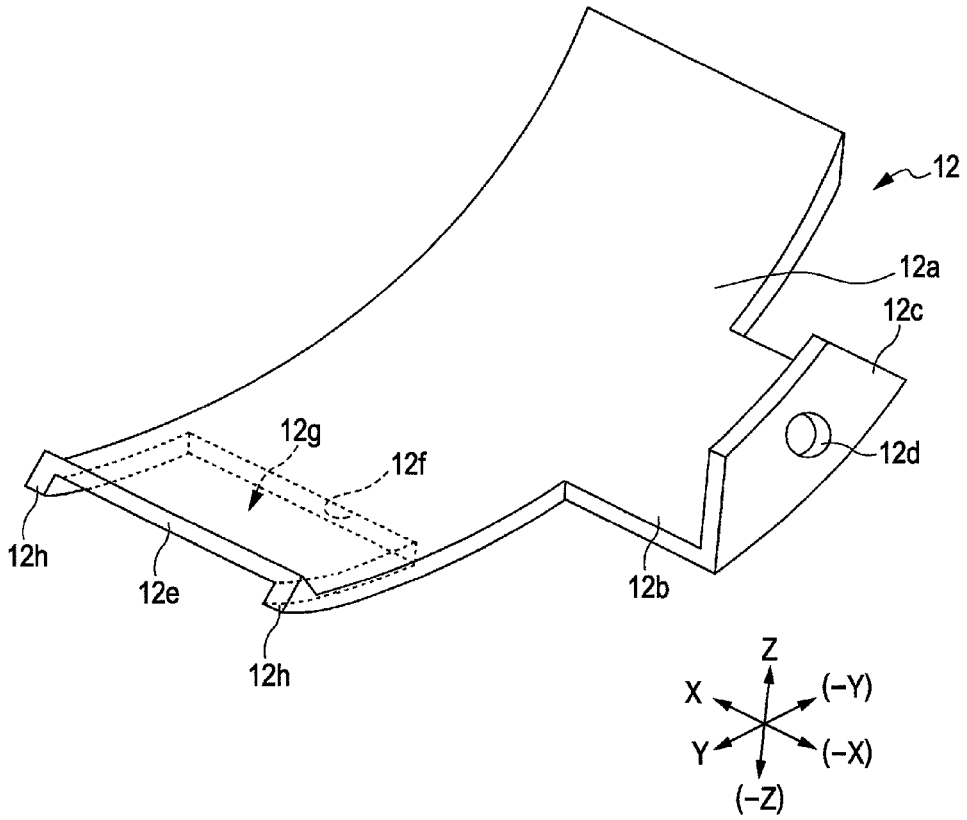
FIG. 11 illustrates a body-side shutter according to the first example.

FIG. 11 illustrates a body-side shutter according to the first example.

Referring to FIGS. 8 to 11, the body-side shutter 12 according to the first example includes a shutter body 12*a* made of an arc-shaped plate. The shutter body 12*a* is an example of an opening/closing member body. From the middle of the shutter body 12*a* in the left-right direction, a rear connection portion 12*b* having a plate-like shape extends rearward. The rear connection portion 12*b* includes a hard key link portion 12*c* having an upwardly bent shape and facing the rear end wall 2*a*. The hard key link portion 12*c* is an example of a rotation linking portion. A through-hole 12*d* is formed in the hard key link portion 12*c*. The through-hole 12*d* has a shape corresponding to the hard key insertion groove 2*c*, and the hard key Kk8 of the toner cartridge Kk may be inserted through the through-hole 12*d*. Therefore, when the toner cartridge Kk rotates in a state in which the hard key Kk8 is inserted through the through-hole 12*d*, the body-side shutter 12 rotates in association with the toner cartridge Kk. Thus, the body-side shutter 12 is moved between an outlet closed position in which the inlet 9 is closed as illustrated in FIG. 10A and an outlet open position in which the inlet 9 is open as illustrated in FIG. 10C. The outlet closed position is an example of a closed position, and the outlet open position is an example of an open position.

At the right end of the shutter body 12*a*, a counter portion 12*e* that is thicker than the shutter body 12*a* is formed. The counter portion 12*e* is an example of an attachment/removal counter portion. In the lower surface of the shutter body 12*a*, a push-up portion 12*f* having an arc-shape is formed so as to extend along the shutter body 12*a*. The push-up portion 12*f* is an example of a scrape limiting portion. A pair of ribs 12*h* are formed at the front and rear ends of the push-up portion 12*f*. The ribs 12*h* are examples of a protrusion. The space surrounded by the pair of ribs 12*h* and the push-up portion 12*f* forms a scrape limiting space 12*g*.

Referring to FIG. 9, in the first example, the width of the push-up portion 12*f* in the front-rear direction is larger than the width of the inlet 9. Lower ends of the ribs 12*h* contact the inlet forming portion 7 at positions outside the edges of the inlet 9. Therefore, the ribs 12*h* contact the upper surface of the inlet forming portion 7 at positions outside the edges of the outlet Kk3 in the front-rear direction from which the developer flows out.

According to the first example, the width of the push-up portion 12*f* in the left-right direction is smaller than the distance between the shutter pressing portion 8 and the right edge of the inlet 9.

Therefore, the body-side shutter 12 is supported so as to be movable between an open position illustrated in FIGS. 9A and 10C and a closed position illustrated in FIGS. 9B and 10A. In the open position, the rear connection portion 12*b* is in contact with and is stopped by a stopper 13 that is supported by the rear end wall 2*a*. In the closed position, the inlet 9 is closed. The stopper 13 is an example of a stopping member.

Referring to FIG. 10B, according to the first example, when the body-side shutter 12 is in the closed position and the inlet 9 is closed, the counter portion 12*e* is disposed in front of the shutter pressing portion 8, and there is a small space between the counter portion 12*e* and the toner cartridge Kk. Thus, overflowing of the developer, which is pushed by the right end surface of the shutter 12 into the shutter passage groove 6, is suppressed.

Referring to FIG. 10B, according to the first example, the width of the push-up portion 12*f* of the body-side shutter 12 in the left-right direction is smaller than the distance between the shutter pressing portion 8 and the right end of the inlet 9. When the body-side shutter 12 is in the closed position, the lower surface of the shutter body 12*a* closes the inlet 9.

Referring to FIGS. 9 and 10, a reserve tank RTk is disposed below the inlet 9. The reserve tank Rtk is an example of a developer reserve member. A pair of agitation-and-transport members RT1 and a supply transport member RT2 are disposed in the reserve tank RTk. The agitation-and-transport members RT1 transport developer that has flowed through the inlet 9 forward or rearward so as to circulate the developer in the reserve tank RTk. The supply transport member RT2, which is disposed in the middle of the agitation-and-transport member RT1 in the left-right direction, supplies the developer that circulates in the reserve tank RTk to the developing unit Gk. The agitation-and-transport members RT1 and the supply transport member RT2 are examples of a transport member.

Description of Toner Cartridge

Referring to FIGS. 9A to 10C, the toner cartridge Kk, which is mounted on the holder base 2 according to the first example, includes a container body Kk1 having a cylindrical shape. The container body Kk1 is an example of a developer container. An outlet portion Kk2 is formed at the rear end of the container body Kk1 so as to protrude outward from the container body Kk1 in the radial direction. An outlet Kk3, through which the developer in the container body Kk1 flows out, is formed in the outlet portion Kk2. The outlet Kk3 is an example of a passage opening. A cartridge shutter Kk4, which is movable along the circumference of the container body Kk1, is mounted on the outlet portion Kk2. The cartridge shutter Kk4 is an example of an opening/closing member. A cartridge seal Kk4*a* is supported on the inner surface of the cartridge shutter Kk that faces the outlet Kk3. The cartridge seal Kk4*a* is an example of a leakage prevention member. The shutter passage groove 6 of the holder base 2 has a depth that allows the cartridge shutter Kk4 to pass therethrough while closing the outlet Kk3. The inlet forming portion 7 has a depth that is smaller than that of the thickness of the cartridge shutter Kk4 and larger than the height by which the outlet portion Kk2 protrudes from the container body Kk1.

Therefore, in the inlet closed position illustrated in FIGS. 5 to 7 and 10A, when the toner cartridge Kk is inserted, the cartridge shutter Kk4 may pass through the shutter passage groove 6 to reach the rear end. If the toner cartridge Kk is inserted in a rotation position in which the cartridge shutter Kk4 does not fit into the shutter passage groove 6, the cartridge shutter Kk4 and the front end surface of the holder base 2 interfere with each other, and the toner cartridge Kk cannot be inserted to the rear end.

When the toner cartridge Kk is inserted to the rear end, the hard key Kk8, which protrudes from the rear end of the toner cartridge Kk, extends through the hard key insertion groove 2*c* and the through-hole 12*d* in the hard key link portion 12*c*. If the toner cartridge Ky, Km, Kc, Ko, or Kg for a different color is inserted, the position of the hard key Kk8 does not match, and the toner cartridge is not inserted to the rear end. Thus, mismount of the toner cartridge is prevented.

When a user rotates a cartridge handle Kk6 at the front end of the toner cartridge Kk in a state in which the toner cartridge Kk is inserted to the rear end, the cartridge shutter Kk4 is not rotated by being engaged with the shutter pressing portion 8, and the container body Kk1 and the outlet portion Kk2 are rotated. The cartridge handle Kk6 is an example of an operation portion. At this time, as the hard key Kk8 rotates, the body-side shutter 12 is rotated in association with the hard key Kk8 by the through-hole 12*d* through which the hard key Kk8 is inserted, and the body-side shutter 12 is moved. Thus, the outlet Kk3 is opened, the inlet 9 is opened, and the outlet Kk3 is connected to the inlet 9 in the outlet open position illustrated in FIGS. 3, 9A, and 10C.

When a driving force is transmitted from the drive source 2*d* to the coupling 3 on the body side, the driving force is transmitted to the coupling CP of the toner cartridge Kk, which engages with the coupling 3 on the body side. Therefore, an agitator CP1, which is disposed in the container body Kk1 and connected to the coupling CP, rotates and transports the developer in the container body Kk1 toward the outlet Kk3, and the developer is supplied through the outlet Kk3. The agitator CP1 is an example of a developer transport member.

Referring to FIG. 9B, in the first example, when the toner cartridge Kk is mounted, the coupling spring 3*a* of the coupling 3 generates an elastic force so as to urge the toner cartridge Kk forward, whereby the toner cartridge Kk is held in a state in which the front end of the outlet portion Kk2 contacts the front end of the shutter guide 11. In the first example, when the front end of the outlet portion Kk2 illustrated in FIG. 9B is in contact with the front end of the shutter guide 11, the width of the outlet Kk3 in the front-rear direction is disposed inside the width of the inlet 9 in the front-rear direction.

As illustrated in FIG. 4, a rotation limiting piece Kk7 is formed at the front end of the toner cartridge Kk according to the first example so as to protrude in the radial direction of the container body Kk1. The rotation limiting piece Kk7 is an example of a limited portion.

Description of Pull-Out Body

Figures 12A, 12B:
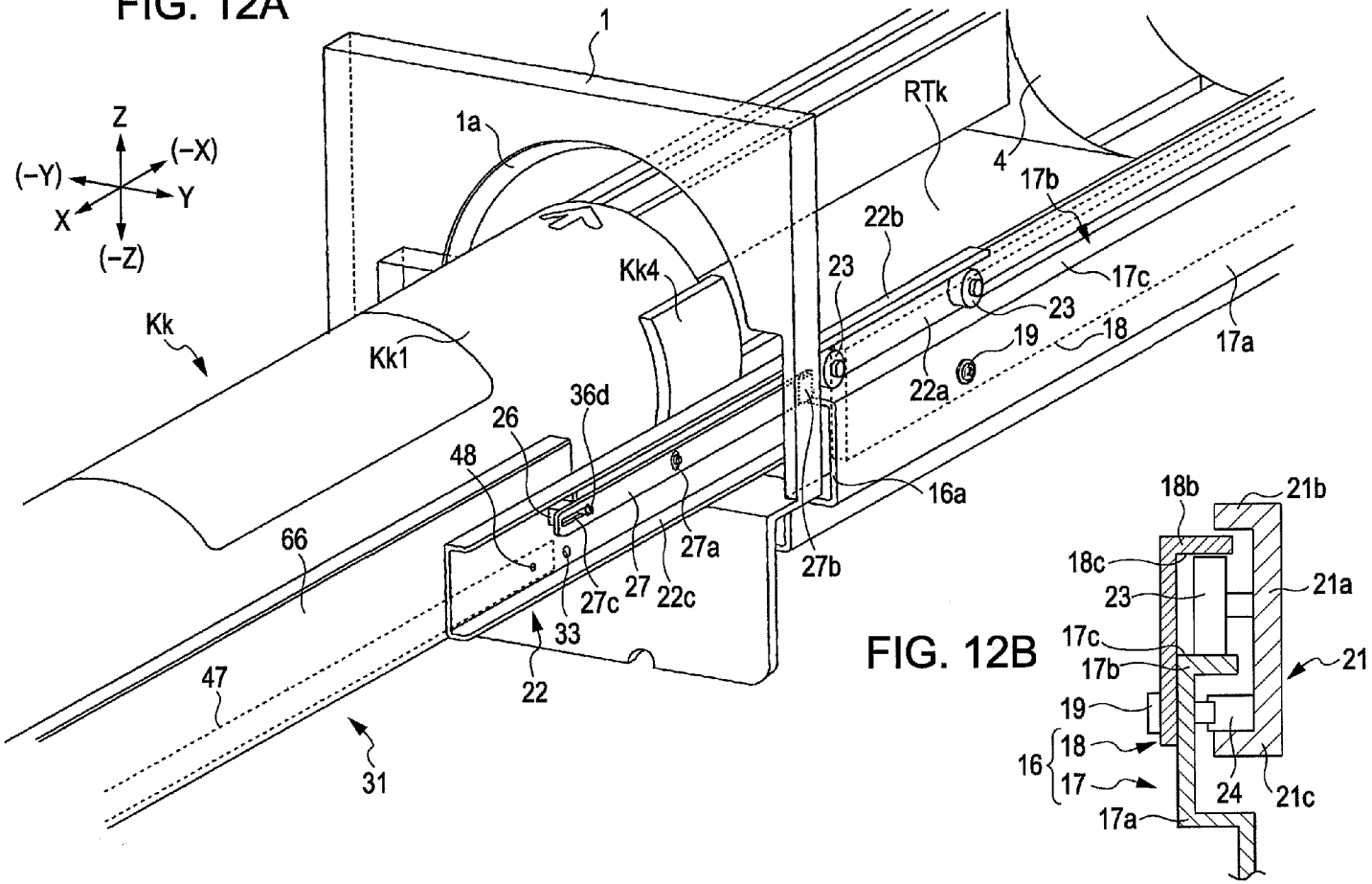

FIGS. 12A and 12B are partial views of a pull-out body according to the first example, in which FIG. 12A is a partial view viewed from the direction of arrow XIIA of FIG. 4, and FIG. 12B is a sectional view taken along line XIIB-XIIB of FIG. 6.

Figure 13:
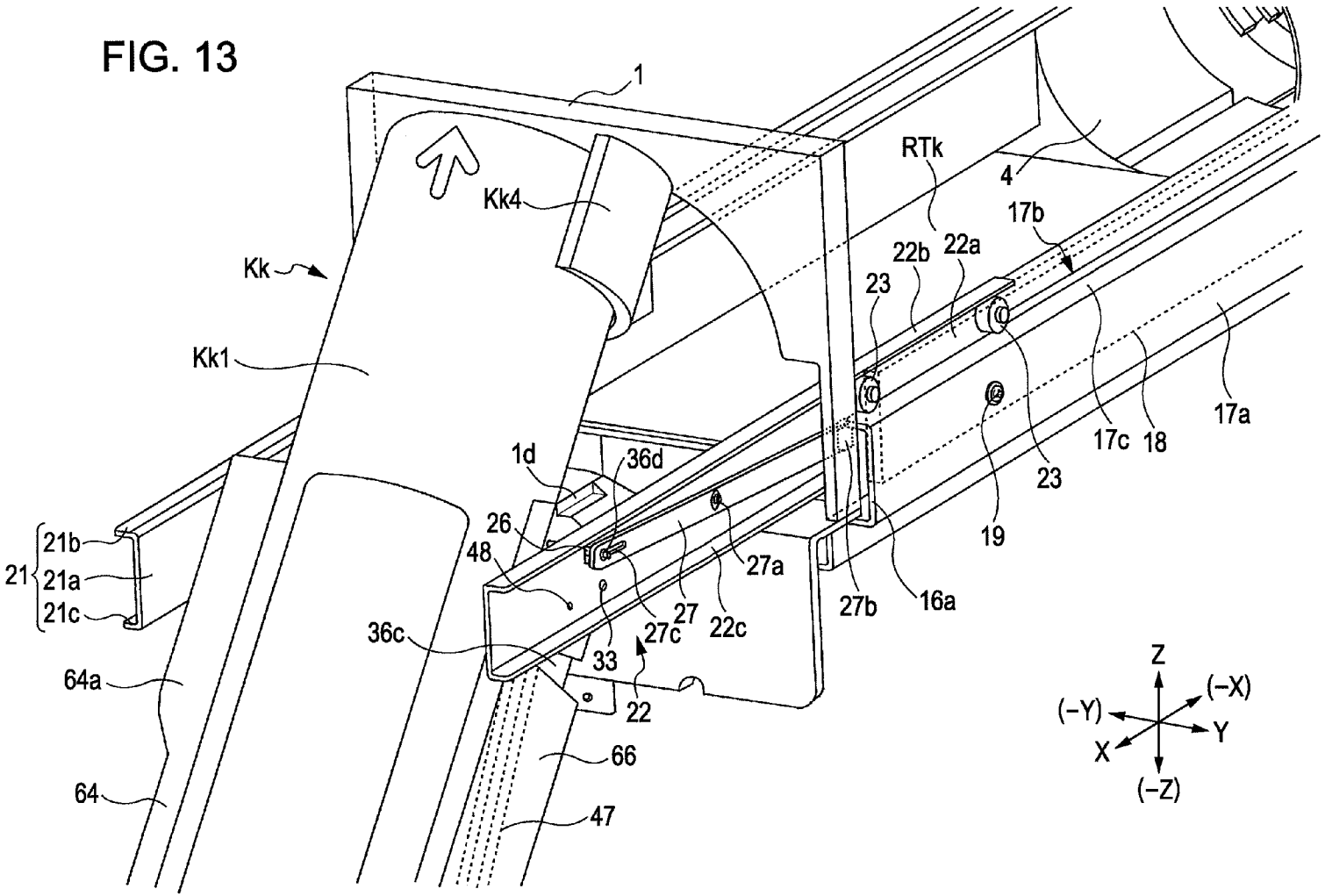
FIG. 13 is a partial view viewed from the direction of arrow XIII of FIG. 5.

FIG. 13 is a partial view viewed from the direction of arrow XIII of FIG. 5.

In FIGS. 12A, 12B, 13, and the following figures, for ease of description and understanding, members that cannot be seen from the outside may be illustrated with solid lines, and member that are disposed outside may be illustrated with broken lines or chain lines, or are not illustrated.

Referring to FIGS. 3 to 7, a pair of guide rails 16 are fixedly supported on the left and right sides of the holder base 2 so as to extend in the front-rear direction. The guide rails 16 are examples of a pull-out guide member. Referring to FIGS. 12A and 13, the guide rail 16 includes a rail body 17 disposed in a lower part thereof in the direction of gravity. The rail body 17 is an example of a guide member body. The rail body 17 includes a side wall portion 17*a*, which extends in the up-down direction, a lower guide portion 17*b* that is bent inward from the upper end of the side wall portion 17*a*.

A lower roller guide surface 17*c* is formed on the upper surface of the lower guide portion 17*b*. An upper guide rail 18, which extends upward, is fixedly supported on the outer side surface of the rail body 17 with a screw 19. The upper guide rail 18 is an example of an upper guide member. The upper guide rail 18 includes an outer cover portion 18*a*, which extends upward, and an upper guide portion 18*b* that is inwardly bent from the upper end of the outer cover portion 18*a*. The outer cover portion 18*a* is an example of a close portion. An upper roller guide surface 18*c* is formed on the lower surface of the upper guide portion 18*b*.

Inward of the pair of guide rails 16, a pair of guided rails 21 and 22 are supported so as to be movable in the front-rear direction. The guided rails 21 and 22 are examples of a pull-out body. Referring to FIGS. 3, 12A, and 13, the guided rails 21 and 22 include pull-out bodies 21*a* and 22*a*, which extend in the up-down-direction, upper guide portions 21*b* and 22*b*, which are bent outward from the upper and lower end portions of the pull-out bodies 21*a* and 22*a*, and lower guided portions 21*c* and 22*c*. The upper guide portions 21*b* and 22*b* is disposed so that the lower surfaces thereof face the upper surface of the upper guide portion 18*b*. The guided rails 21 and 22 are supported so as to be movable in the forward direction that is a pull-out direction and in the rearward direction that is a push-in direction.

A pair of rollers 23 are rotatably supported on a rear portion of each of the pull-out bodies 21*a* and 22*a*. The rollers 23 are sandwiched between the lower roller guide surface 17*c* and the upper roller guide surface 18*c* of the guide rail 16. The rollers 23 are examples of a guided member. Therefore, when the guided rails 21 and 22 move, the rollers 23 rotate on the roller guide surfaces 17*c* and 18*c*, so that friction drag and the like may be reduced and the guided rails 21 and 22 are movable with a weaker force than when the rollers 23 are not disposed.

Referring to FIG. 3, a stopper 24 is formed in the rear portion of each of the pull-out bodies 21*a* and 22*a* so as to protrude toward the side wall portion 17*a* of the guide rail 16. The stopper 24 is an example of pull-out stopped portion. For convenience of illustration, only the stopper 24 formed on the left guide rail 21 is illustrated in FIG. 3. Referring to FIG. 12B, the stopper 24 is disposed so as to be capable of being in contact with and separated from the inner end of the screw 19, which extends through the upper guide rail 18 and fixes the upper guide rail 18 to the rail body 17. The screw 19 is an example of a pull-out stopping portion. Therefore, when the guided rails 21 and 22 are pulled out forward to the pulled-out position illustrated in FIG. 4, the stopper 24 contacts the screw 19 and thereby the guided rails 21 and 22 cannot be moved further forward. Thus, the guided rails 21 and 22 according to the first example are supported so as to be movable between the installed position illustrated in FIG. 3 and the pulled-out position illustrated in FIG. 4.

Referring to FIGS. 12 and 13, a through hole 26 extends through a front portion of the pull-out body 22*a* of the guided rail 22.

On the guided rail 22 on the right side, a link 27 is supported so as to extend in the front-rear direction and parallel to the outer side surface of the guided rail 22 in the rear of the through hole 26 and so as to be rotatable around a link rotation center 27*a*. The link 27 is an example of a link member. A stopped portion 27*b* having a J-shape is formed at the rear end of the link 27. The stopped portion 27*b* may be in contact with and separated from a misinsertion stop portion 16*a* at the front end of the guide rail 16 on the right side. Therefore, the link 27 is supported so as to be rotatable around the link rotation center 27*a* between a stopper separation position illustrated in FIG. 12 and a stopper contact position illustrated in FIG. 13. When the link 27 is in the stopper separation portion, the stopped portion 27*b* is separated from the misinsertion stop portion 16*a* and the guided rail 22 is movable between the installed position and the pulled-out position. When the link 27 is in the stopper contact portion, the stopped portion 27*b* is in contact with the misinsertion stop portion 16*a* and movement of the guided rail 22 from the pulled-out position to the installed position is suppressed.

At the front end of the link 27, a connection hole 27*c* having an elongated shape and extending in the front-rear direction is formed so as to correspond to the through hole 26.

Description of Tilt Holder

Figure 14:
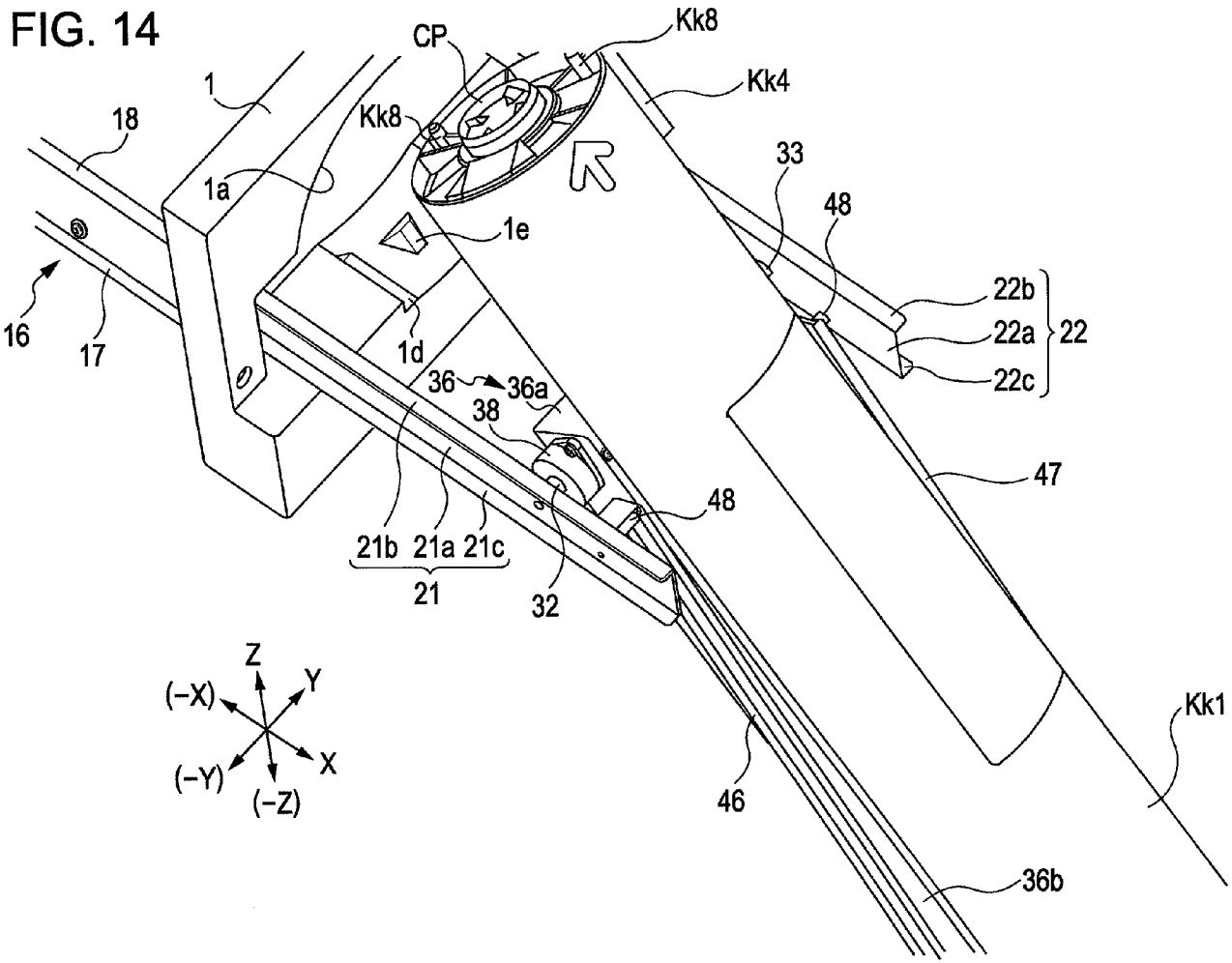
FIG. 14 illustrates a brake member according to the first example.

FIG. 14 illustrates a brake member according to the first example.

For ease of understanding, a holder cover is not illustrated in FIG. 14.

Referring to FIGS. 3 to 13, at the front end of the guided rails 21 and 22, a tilt holder 31 is supported so as to be rotatable around holder rotation shafts 32 and 33. The tilt holder 31 is an example of a rotary holder. The tilt holder 31 includes a holder frame 36, which is an example of a frame body. Referring to FIG. 14, the holder frame 36 includes a holder frame bottom wall 36*a*, a holder frame left side wall 36*b*, and a holder frame right side wall 36*c*. The holder frame bottom wall 36*a* has a plate-like shape and extends along the axis of the toner cartridge Kk. The holder frame left side wall 36*b* and the holder frame right side wall 36*c* extend upward on the sides ends of the holder frame bottom wall 36*a*. The holder rotation shafts 32 and 33 are connected to rear ends of the holder frame left side wall 36*b* and the holder frame right side wall 36*c*.

Referring to FIGS. 12 and 13, a link connection pin 36*d*, which extends rightward, is supported on the holder frame right side wall 36*c* on a rear side of the right holder rotation shaft 33. The link connection pin 36*d* is an example of a connection body. The link connection pin 36*d* extends through the through hole 26 in the guided rail 22 and is connected to the connection hole 27*c* in the link 27. The connection hole 27*c* according to the first example is a hole having an elongated shape, and the link connection pin 36*d* is connected to the connection hole 27*c* so as to be movable along the connection hole 27*c*. As illustrated in FIGS. 12 and 13, the link connection pin 36*d* is disposed in the vicinity of the holder rotation shaft 33 so as not to be concentric to the holder rotation shaft 33.

Therefore, when the tilt holder 31 rotates around the holder rotation shafts 32 and 33, the link 27, which is connected to the tilt holder 31 through the link connection pin 36*d*, is rotated between the stopper separation position illustrated in FIG. 12 and the stopper contact position illustrated in FIG. 13.

Referring to FIG. 14, a one-way hinge 38 is attached to the left holder rotation shaft 32. The one-way hinge 38 is an example of a brake member or an overload protection mechanism. The one-way hinge 38 functions as an overload protection mechanism (torque limiter) that interrupts transmission of torque if the strength of the torque exceeds a preset value and as a one-way rotation disconnection mechanism (one-way clutch) that transmits rotation in one direction but does not transmit rotation in the other direction by idling. The one-way hinge 38 is a marketed component. The one-way hinge 38 according to the first example interrupts transmission of torque, which is directed in a specific rotation direction around the holder rotation shaft 32, if the strength of the torque is larger than a preset torque, and transmits a torque if the torque is applied in a rotation direction opposite to the specific rotation direction. That is, transmission of torque is interrupted if the torque in a tilt rotation direction, which is directed from the insertable position illustrated in FIG. 4 to a tilt position (an example of a mount/dismounted position), is larger than the preset torque, whereby the rotation speed of the tilt holder 31 is limited. On the other hand, torque in a recovery rotation direction, which is directed from the tilt position to the insertable position, is transmitted. In the first example, the preset torque is set to be smaller than the free rotation toque of the tilt holder 31 due to gravitation.

Figures 15A, 15B:
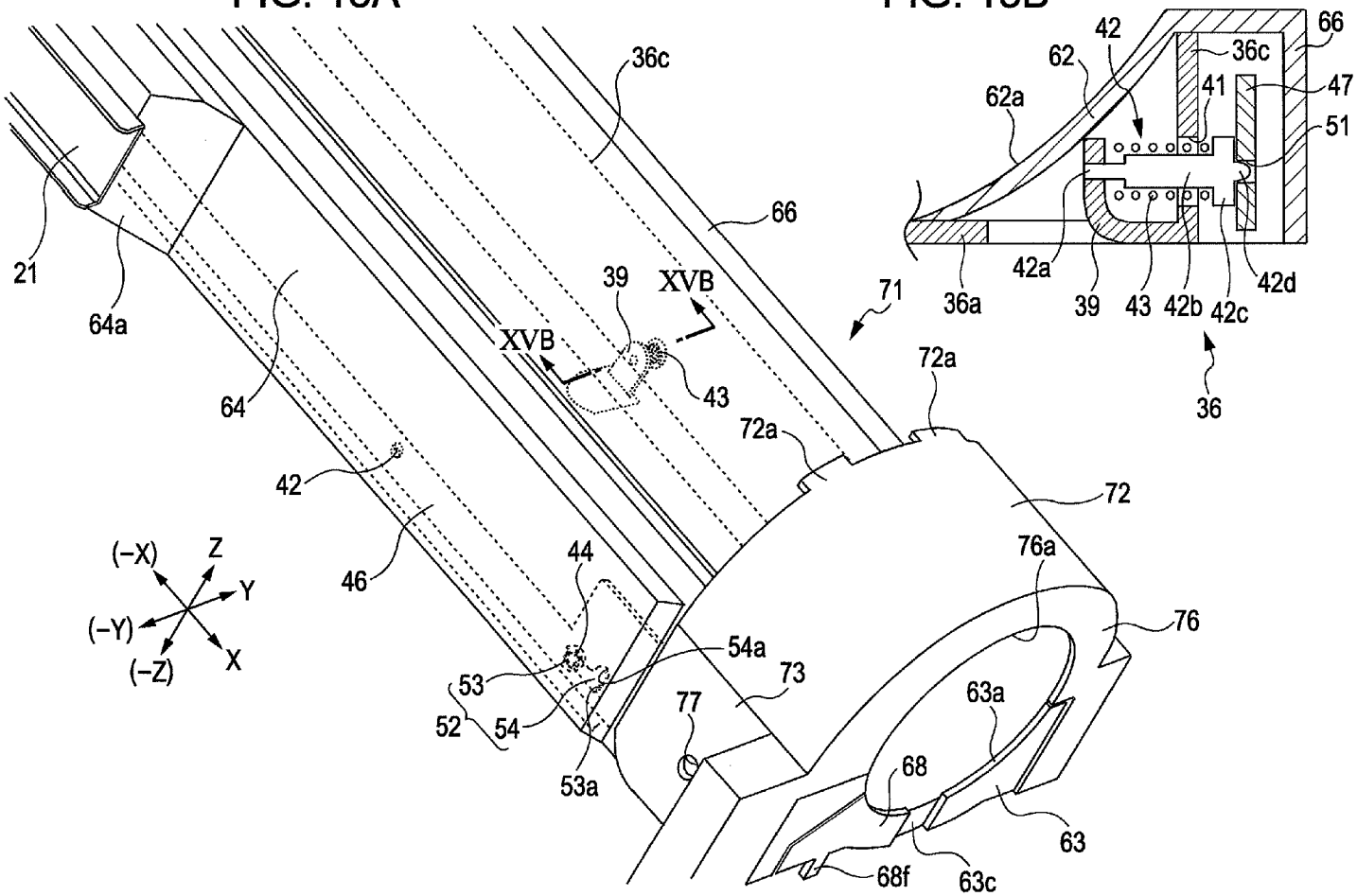

FIGS. 15A and 15B are partial views of a tilt holder according to the first example, in which FIG. 15A is a partial view of a front portion of the tilt holder when the tilt holder is in the insertable position illustrated in FIG. 4, and FIG. 15B is a sectional view taken along line XVB-XVB of FIG. 15A.

Figure 16:
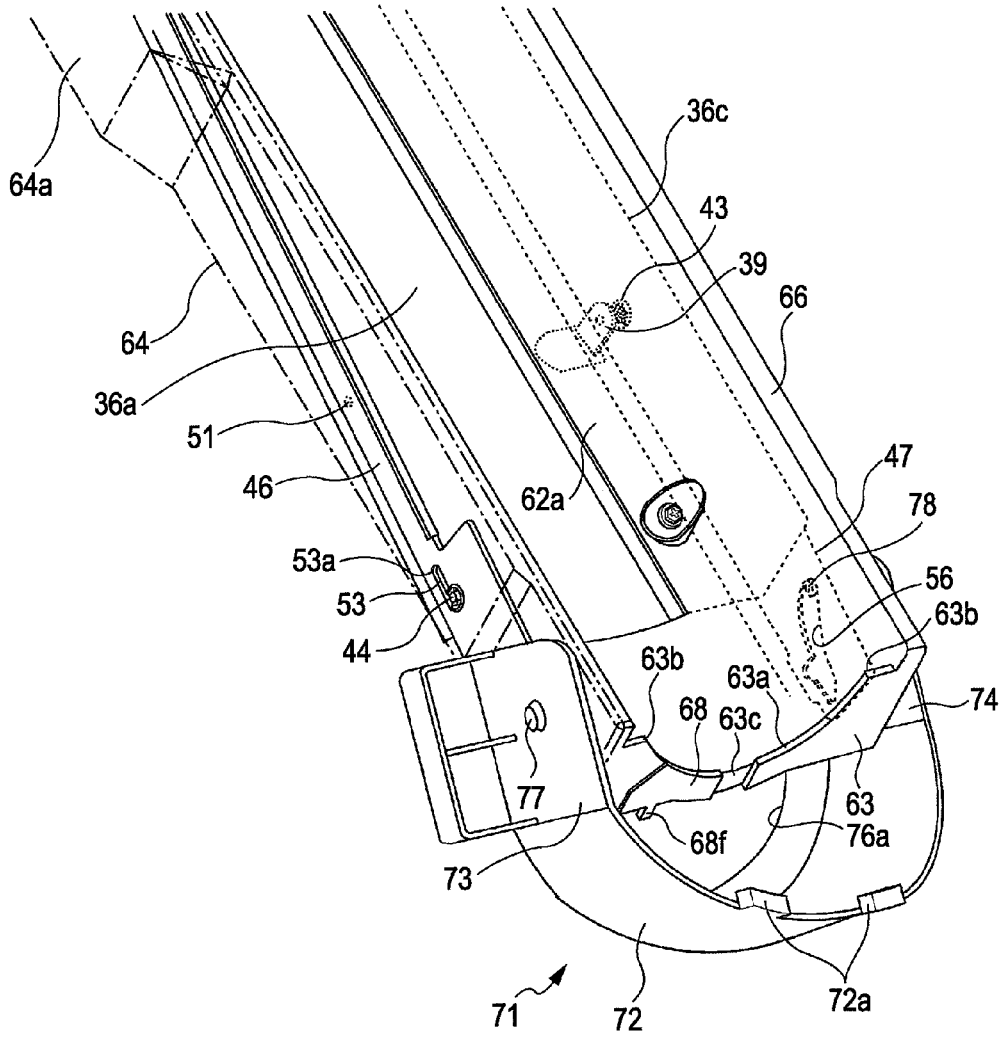
FIG. 16 is a partial view of the tilt holder according to the first example, illustrating a front portion of the tilt holder when the tilt holder is in the tilt position illustrated in FIG. 7.

FIG. 16 is a partial view of the tilt holder according to the first example, illustrating a front portion of the tilt holder when the tilt holder is in the tilt position illustrated in FIG. 7.

Referring to FIGS. 15 and 16, a pair of cut-and-raised portions 39 are formed in the front portion of the holder frame bottom wall 36*a* of the holder frame 36. For convenience of illustration, only the right cut-and-raised portion 39 is illustrated in FIGS. 15 and 16.

Referring to FIGS. 15 and 16, a pin-passage opening 41 extends through each of the holder frame side walls 36*b* and 36*c* in the left-right direction so as to face the cut-and-raised portion 39. The pin-passage opening 41 is an example of a latch-passage opening. A pin 42 is supported on the cut-and-raised portion 39. The pin 42 extends through the pin-passage opening 41 and protrude outward from each of the holder frame side walls 36*b* and 36*c*, and is movable in the left-right direction. The pin 42 is an example of a hook member.

Referring to FIG. 15B, the pin 42 includes a supported portion 42*a*. The supported portion 42*a* is inserted through a support hole 39*a* in the cut-and-raised portion 39, and is movable in the left-right direction. Outside of the supported portion 42*a*, a pin body 42*b* is integrally formed with the supported portion 42*a*. The pin body 42*b* extends through the pin-passage opening 41 and has a large diameter than the supported portion 42*a*. At the outer end of the pin body 42*b*, a spring supporting portion 42*c* is integrally formed with the pin body 42*b*. The spring supporting portion 42*c*, which is disk-shaped. The spring supporting portion 42*c* includes a latch 42*d* that protrudes outward from the spring supporting portion 42*c*.

Referring to FIGS. 15 and 16, a pin urging spring 43 is disposed between the cut-and-raised portion 39 and the spring supporting portion 42*c*. The pin urging spring 43 urges the spring supporting portion 42*c* outward. The pin urging spring 43 is an example of an urging member.

A pair of support connection studs 44 are supported on the holder frame side walls 36*b* and 36*c* at positions further forward from the cut-and-raised portion 39 so as to extend outward from the holder frame side walls 36*b* and 36*c*. The support connection studs 44 are examples of a rotation limiting portion.

Figure 17:
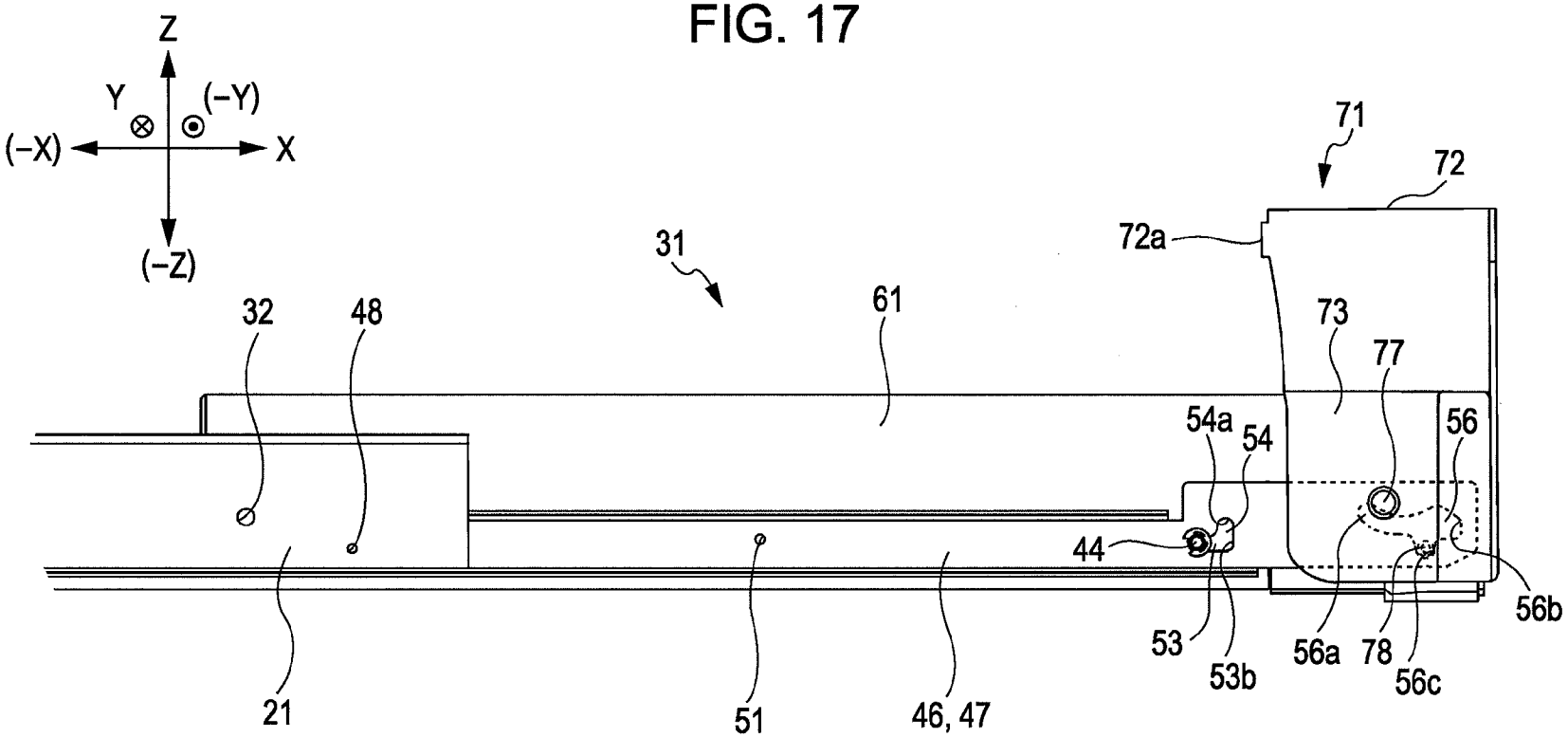
FIG. 17 is a partial view of a support when the guided rails are in the pulled-out positions and the tilt holder is in the insertable position.

FIG. 17 is a partial view of a support when the guided rails are in the pulled-out positions and the tilt holder is in the insertable position.

Figure 18:
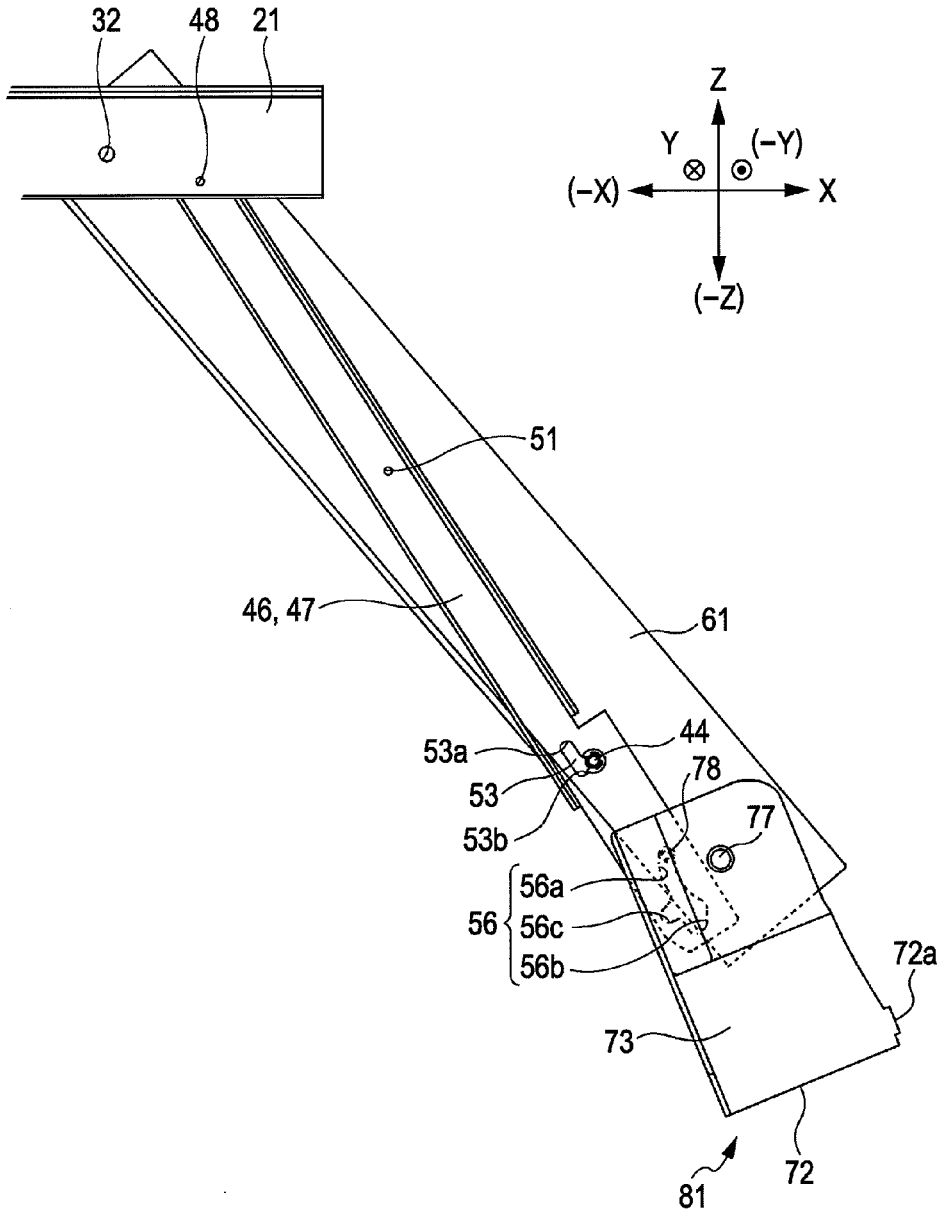
FIG. 18 is a partial view of the support when the tilt holder is moved from the position illustrated in FIG. 17 to the tilt position and the front end cover is moved to the open position.

FIG. 18 is a partial view of the support when the tilt holder is moved from the position illustrated in FIG. 17 to the tilt position and the front end cover is moved to the open position.

Referring to FIGS. 12 to 18, a left-side support 46 and a right-side support 47 are respectively disposed outside of the holder frame side wall 36*b* and 36*c* of the holder frame 36. The left-side support 46 and the right-side support 47 each have a plate shape and extend in the front-rear direction. The left-side support 46 and the right-side support 47 are examples of an auxiliary rotating body. Rear ends the supports 46 and 47 are rotatably supported on the guided rails 21 and 22 through support rotation shafts 48 that are disposed at positions displaced forward from the that the holder rotation shafts 32 and 33. The support rotation shafts 48 are examples of an auxiliary rotation shaft. As illustrated in FIGS. 12 to 14, in the first example, the support rotation shafts 48 are disposed in the vicinity of and separated from the holder rotation shafts 32 and 33.

Referring to FIGS. 12 to 18, latch holes 51 are formed in the middle of the supports 46 and 47 in the front-rear direction at positions corresponding to the latches 42*d* when the tilt holder 31 is in the insertable position illustrated in FIG. 17. The latch holes 51 are examples of a latched portion. That is, when the tilt holder 31 is in the insertable position illustrated in FIG. 17, latches 42*d* are inserted into and held by the latch holes 51 as illustrated in FIG. 15B due to elastic forces applied by the pin urging springs 43. When the tilt holder 31 is in the tilt position illustrated in FIG. 18, the holder rotation shafts 32 and 33 of the holder frame 36 are displaced from the support rotation shafts 48, and the latches 42*d* are displaced from the latch holes 51. Therefore, the latches 42*d* are moved inward against the elastic forces of the pin urging spring 43, so that the latches 42*d* are pulled out of the latch holes 51.

Referring to FIGS. 15 to 18, a tilt stop groove 52 is formed in a front portion of each of the supports 46 and 47 at a position corresponding to the support connection stud 44. Referring to FIGS. 15 and 17, the tilt stop groove 52 includes a guide groove 53, which extends along a corresponding one of the supports 46 and 47, and an upward rotation limiting groove 54, which extends upward from a front end of the guide groove 53. The tilt stop groove 52 is a substantially L-shaped groove along which the support connection stud 44 may move. Referring to FIGS. 15 to 18, an upward rotation lock surface 53*a* is formed at a rear end of the guide groove 53. When the tilt holder 31 is in the insertable position illustrated in FIG. 17, the upward rotation lock surface 53*a* contacts the support connection stud 44 and limits rotation of the tilt holder 31 above the insertable position. The upward rotation lock surface 53*a* is an example of an upward rotation limiting portion.

A downward rotation lock surface 53*b* is formed at a front end of the guide groove 53. When the tilt holder 31 is in the tilt position illustrated in FIG. 18, the downward rotation lock surface 53*b* contacts the support connection stud 44 and limits rotation of the tilt holder 31 below the tilt position. The downward rotation lock surface 53*b* is an example of a downward rotation limiting portion. That is, the tilt holder 31 is in the tilt position when the support connection stud 44 contacts the downward rotation lock surface 53*b*, and the tilt holder 31 is held in the tilt position owing to the contact between the support connection stud 44 and the downward rotation lock surface 53*b*.

The inner peripheral surface of the rotation limiting groove 54, which is disposed above the downward rotation lock surface 53*b*, forms a rotation lock surface 54*a*. The rotation lock surface 54*a* is an example of an opening limitation limiting portion.

Figure 19:
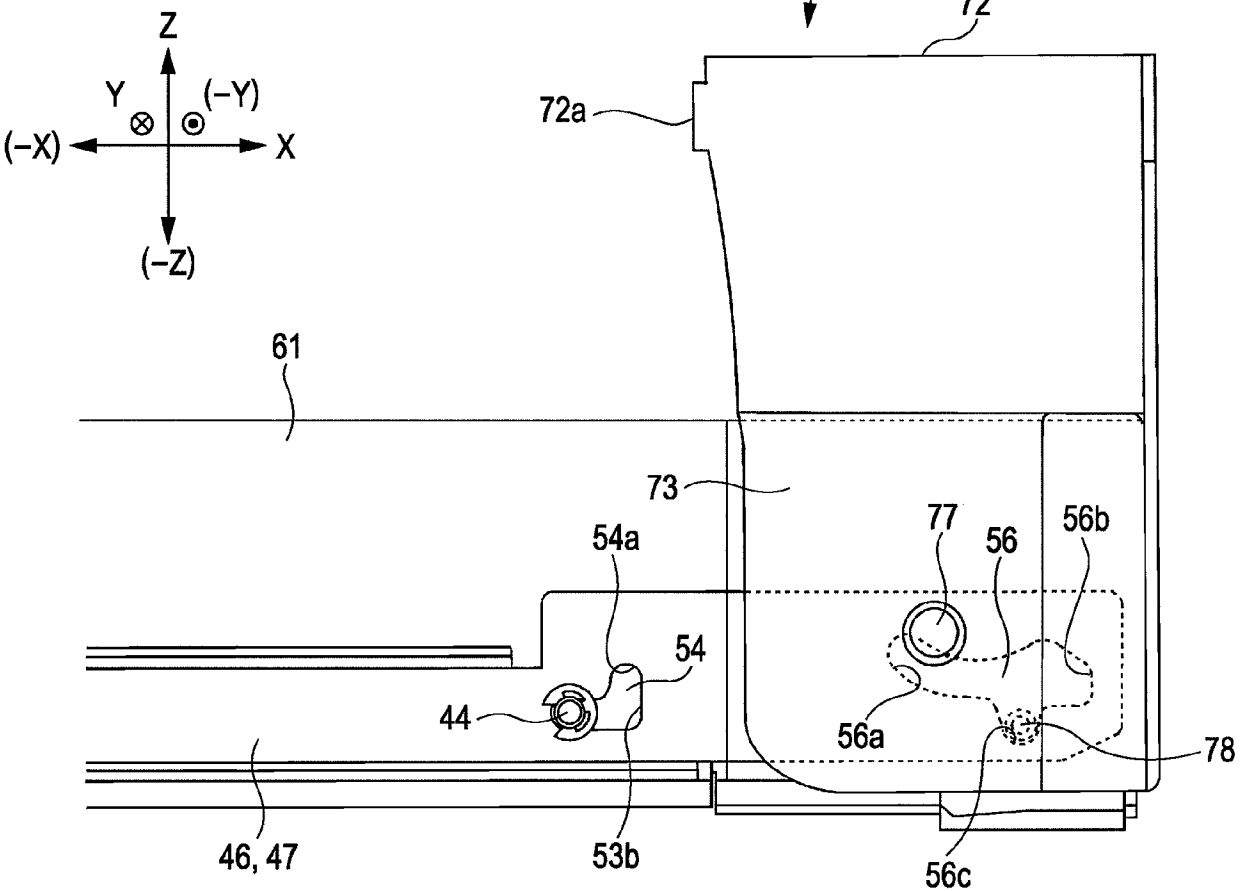
FIG. 19 illustrates a front end portion of the tilt holder according to the first example when the tilt holder is in the insertable position.

FIG. 19 illustrates a front end portion of the tilt holder according to the first example when the tilt holder is in the insertable position.

Figure 20:
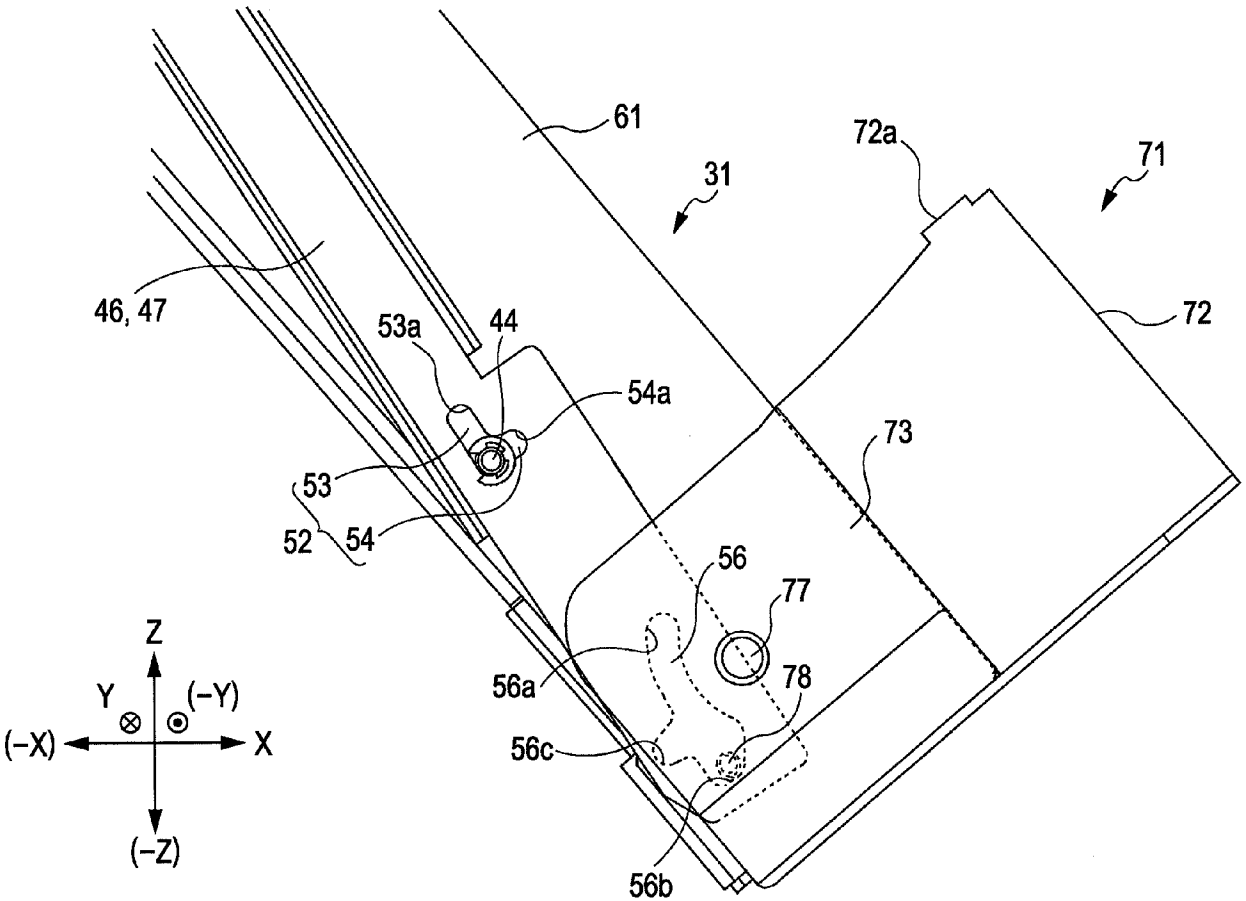
FIG. 20 illustrates the front end portion of the tilt holder according to the first example when the tilt holder is in the tilt position.

FIG. 20 illustrates the front end portion of the tilt holder according to the first example when the tilt holder is in the tilt position.

Figure 21:
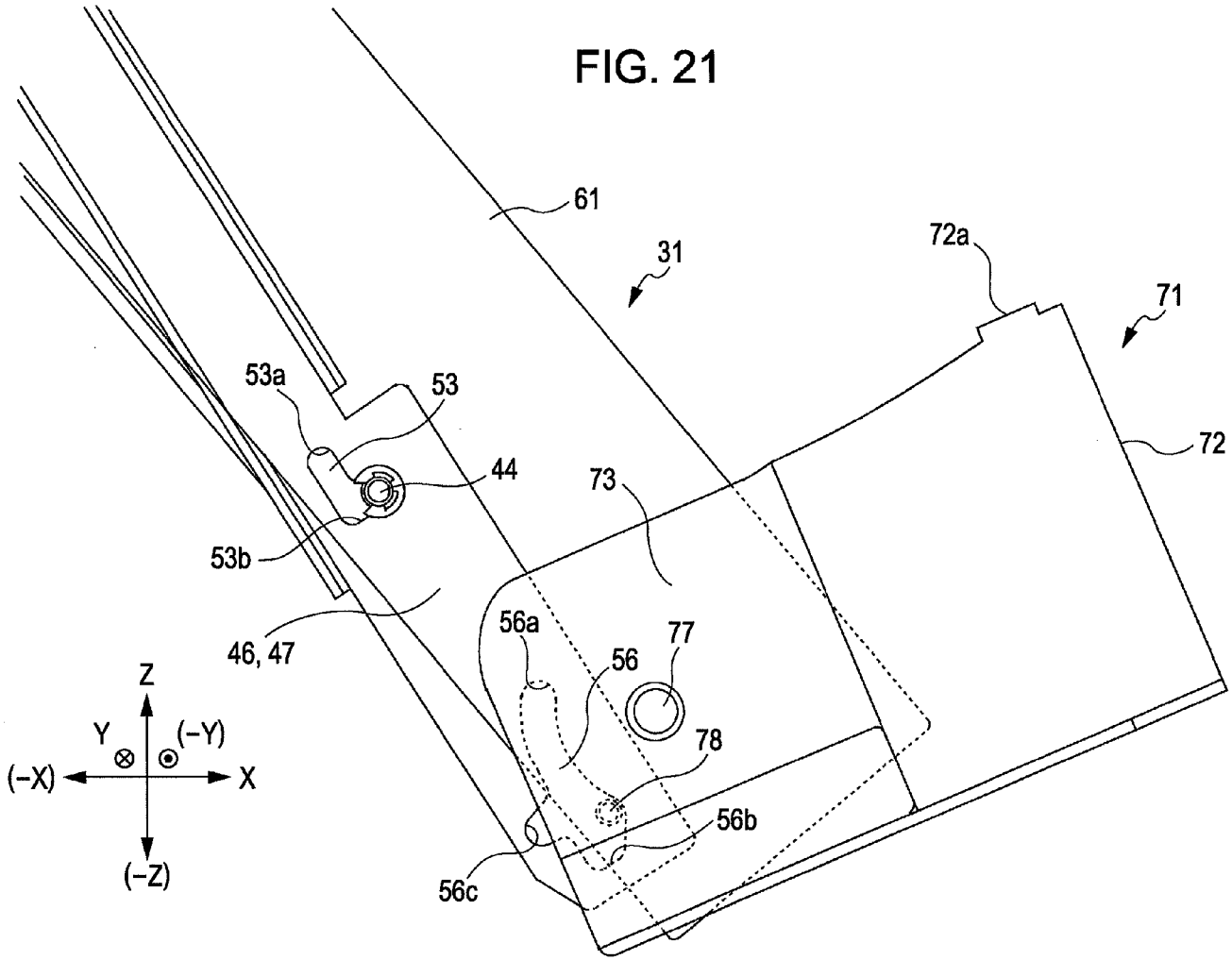
FIG. 21 illustrates the front end portion of the tilt holder according to the first example when the front end cover is rotating from the state illustrated in FIG. 20 toward the front end open position.

FIG. 21 illustrates the front end portion of the tilt holder according to the first example when the front end cover is rotating from the state illustrated in FIG. 20 toward the front end open position.

Figure 22:
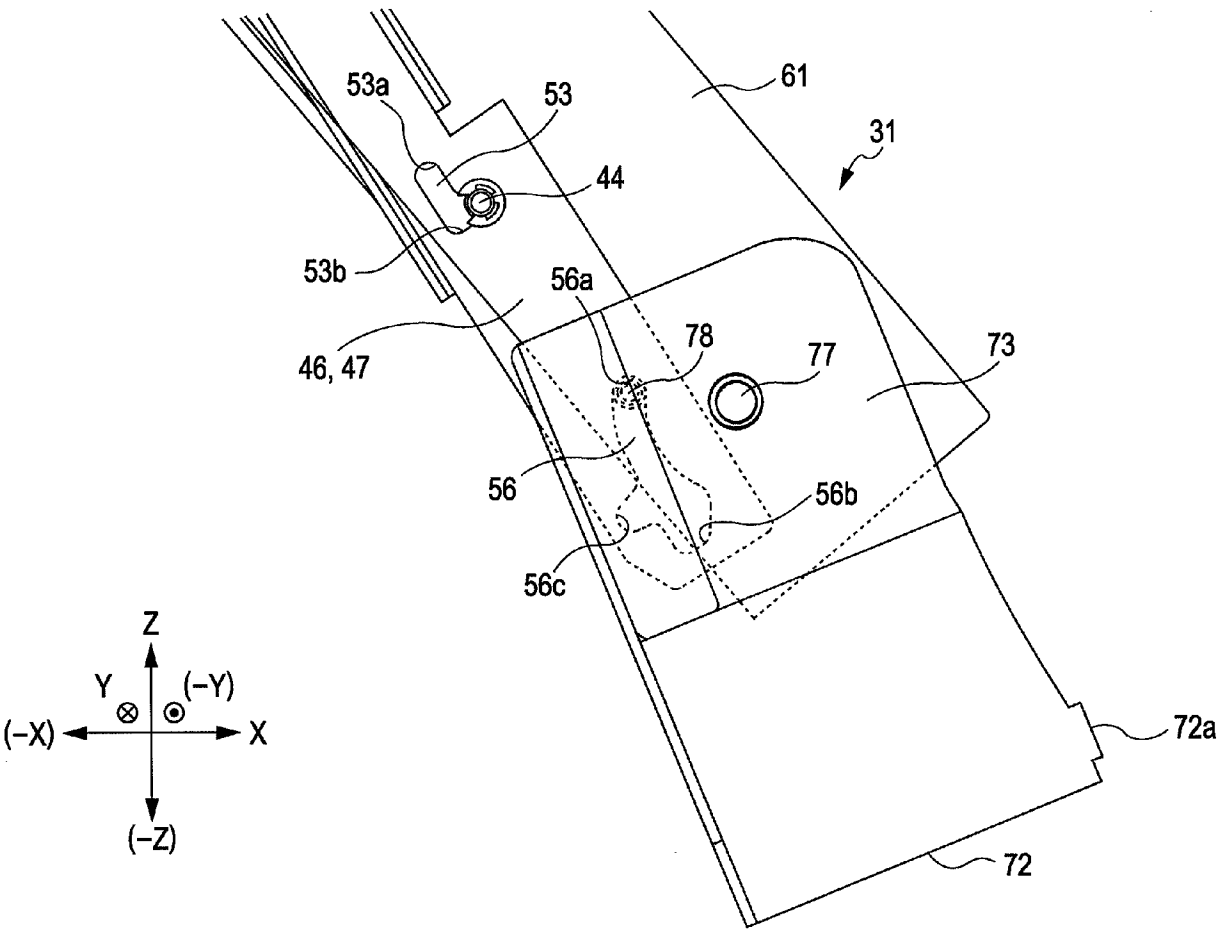
FIG. 22 illustrates the front end portion of the tilt holder according to the first example when the front end cover has moved to the front end open position from the state illustrated in FIG. 21.

FIG. 22 illustrates the front end portion of the tilt holder according to the first example when the front end cover has moved to the front end open position from the state illustrated in FIG. 21.

Referring to FIGS. 17 to 22, a lock opening 56 is formed in a front end of each of the supports 46 and 47 so as to extend through a corresponding one of the supports 46 and 47. The lock opening 56 is an example of a rotation linked portion.

Referring to FIG. 19, the lock opening 56 includes a cover stud guide groove 56*a*, a support lock release portion 56*b*, and a cover lock portion 56*c*. The cover stud guide groove 56*a* extends from a rear end of the lock opening 56 and has a downwardly convex arc-shape. The cover stud guide groove 56*a* is an example of a guide portion. The support lock release portion 56*b*, which is formed so as to be continuous with a front end of the cover stud guide groove 56*a*, has an inner surface that extends downward toward the front and then extends downward in the direction of gravity. The support lock release portion 56*b* is an example of a rotation limit release member. The cover lock portion 56*c* is integrally formed with the support lock release portion 56*b* and recessed downward with respect to the lower surface of the support lock release portion 56*b*. The cover lock portion 56*c* is an example of an open/close movement limiting portion.

Figure 23:
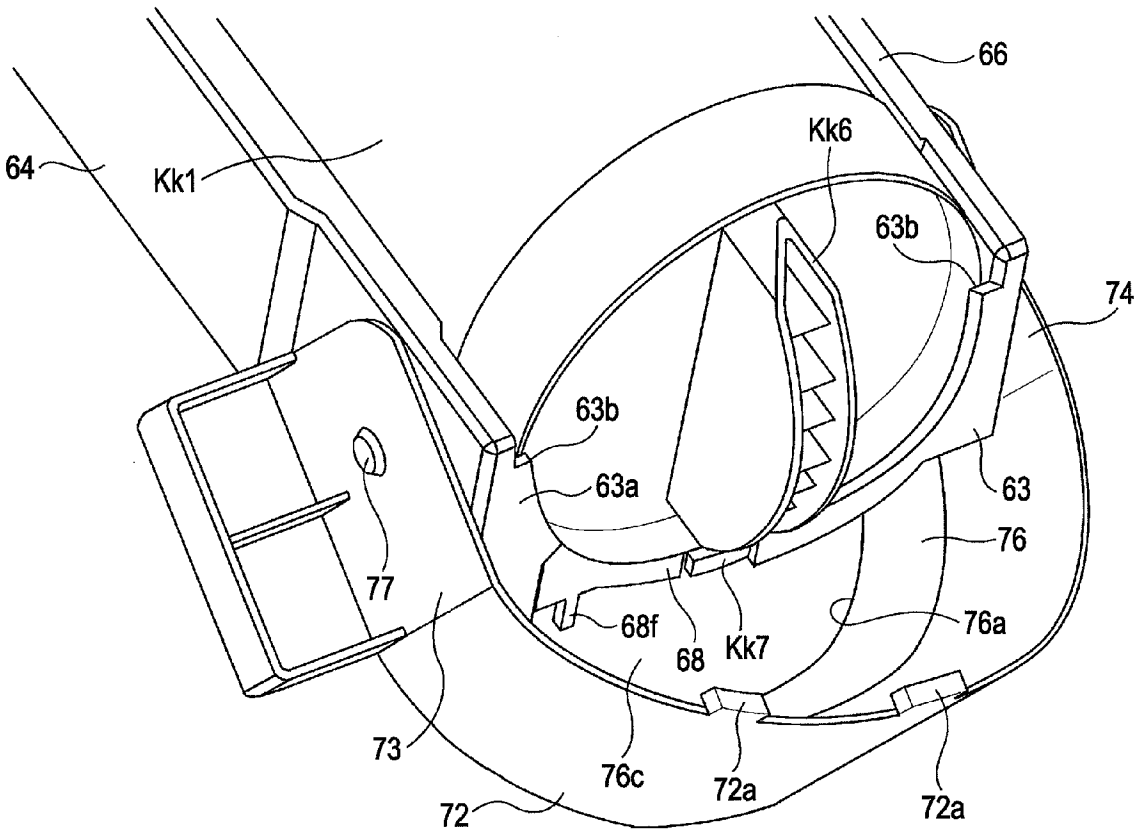
FIG. 23 is a partial view of the tilt holder and the front end cover according to the first example when the toner cartridge is mounted as illustrated in FIG. 6.

FIG. 23 is a partial view of the tilt holder and the front end cover according to the first example when the toner cartridge is mounted as illustrated in FIG. 6.

Referring to FIGS. 7 and 15 to 18, a holder cover 61 is fixedly supported on the holder frame 36. The holder cover 61 is an example of a holder covering member. The holder cover 61 includes an upper cover 62 disposed on the front side and on the left and right sides of the bottom wall 36*a* of the holder frame 36. The upper cover 62 is an example of an upper cover portion. The upper cover 62 includes a cartridge holding surface 62*a* that is a semi-cylindrical upper surface. The cartridge holding surface 62*a* is an example of a removable unit hold surface.

Referring to FIGS. 16 and 23, a front end wall 63 is integrally formed with the front end of the upper cover 62. The front end wall 63 is an example of a front end support portion. An opening 63*a* is formed in the front end wall 63. The opening 63*a* is arc-shaped and has a diameter smaller than that of the toner cartridge Kk that is inserted. A rotation limiting mount portion 63*a*1 is formed at a lower left portion of the opening 63*a*, and the rotation limiting mount portion 63*a*1 has a diameter that is substantially equal to that of the toner cartridge Kk. Thus, the front end wall 63 has a shape that protrudes inward relative to the ends of the width of the toner cartridge Kk that is inserted. Therefore, when the toner cartridge Kk is inserted, the front end wall 63 supports the front end surface of the toner cartridge Kk. Therefore, a pair of guide corners 63*b* are formed at the upper end corners of the front end wall 63. The distance between the guide corners 63*b* is smaller than the diameter of the toner cartridge Kk. The guide corners 63*b* are examples of a front end guide portion.

Figure 24:
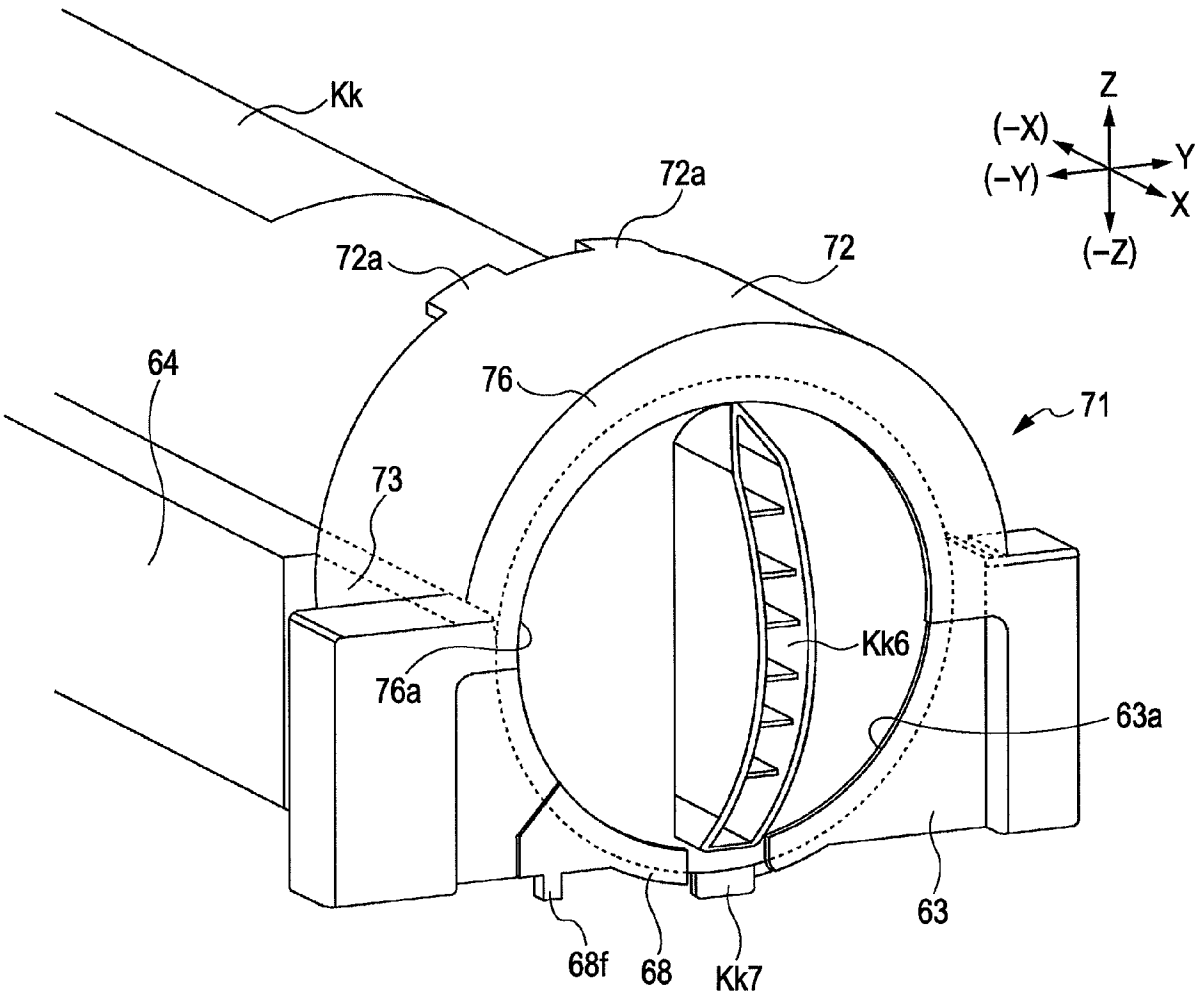
FIG. 24 is a partial view of tilt holder according to the first example when the front cover of the tilt holder is in a front end closed position.

FIG. 24 is a partial view of tilt holder according to the first example when the front cover of the tilt holder is in a front end closed position.

Figure 25:
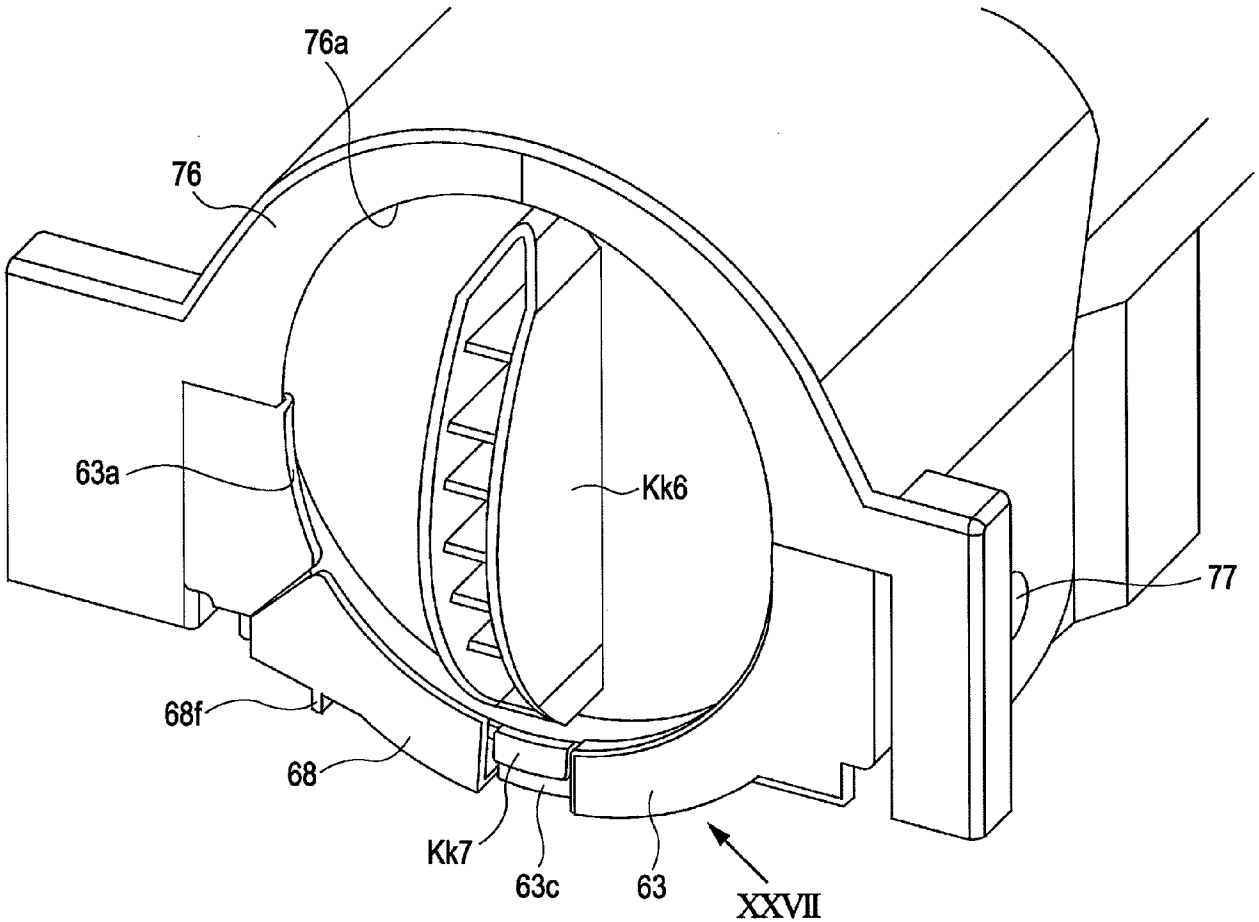
FIG. 25 is a partial view of a rotation limiting mechanism according to the first example.

FIG. 25 is a partial view of a rotation limiting mechanism according to the first example.

Figure 26A:
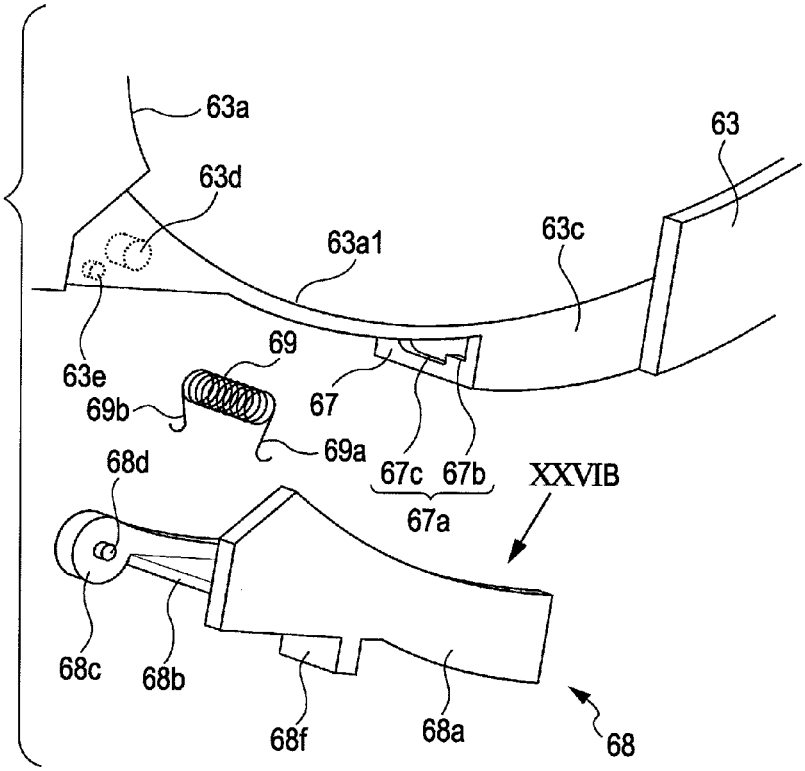
Figure 26B:
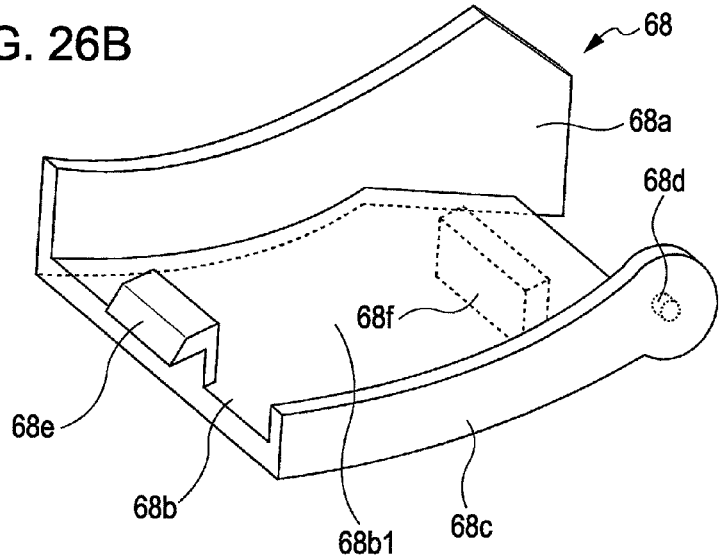

FIGS. 26A and 26B illustrate the rotation limiting mechanism according to the first example, in which FIG. 26A is an exploded view, and FIG. 26B is a view in the direction of arrow XXVIB of FIG. 26A.

Referring to FIGS. 16 and 23 to 25, a rib contact portion 63*c* is formed at the lower end of the front end wall 63. The rib contact portion 63*c* is recessed rearward from the front end wall 63 and extends downward. The rib contact portion 63*c* is contactable with the rotation limiting piece Kk7.

Referring to FIG. 26A, a spring mounting protrusion 63*d* protrudes from a rear surface of the rotation limiting mount portion 63*a*1 of the front end wall 63. The spring mounting protrusion 63*d* is an example of an urge mount portion. An arm hook protrusion 63*e* is formed in the vicinity of the spring mounting protrusion 63*d* so as to extend rearward. The arm hook protrusion 63*e* is an example of an arm supporting body.

Referring to FIGS. 3 to 7, 15, 16, 23, and 24, at the left upper edge of the upper cover 62, a left cover 64 is integrally formed with the upper cover 62 so as to cover the outer side of the left side wall 36*b* and the left-side support 46. At the rear end of the left cover 64, a rear end protection portion 64*a* is formed. The rear end protection portion 64*a* has a width in the left-right direction that is larger than the width of the middle portion of the left cover 64 in the front-rear direction. The rear end protection portion 64*a* prevents the left-side support 46 and the one-way hinge 38 from being exposed to the outside and occupies the space between the left side wall 36*b* and the left guided rail 21.

Referring to FIGS. 3 to 7, 15, 16, 23, and 25, at the upper right end of the upper cover 62, a right cover 66 is integrally formed with the upper cover 62 so as to cover the outer sides of the right side wall 36*c* and the right-side support 47.

The holder frame 36 and the holder cover 61 constitute a holder body (36+61) that holds the toner cartridge Kk.

Description of Rotation Limiting Mechanism

Figure 27A:
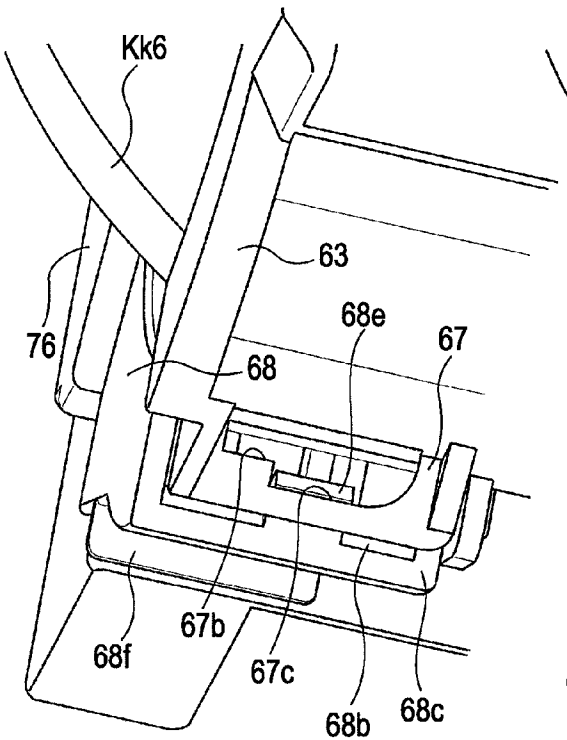
Figure 27B:
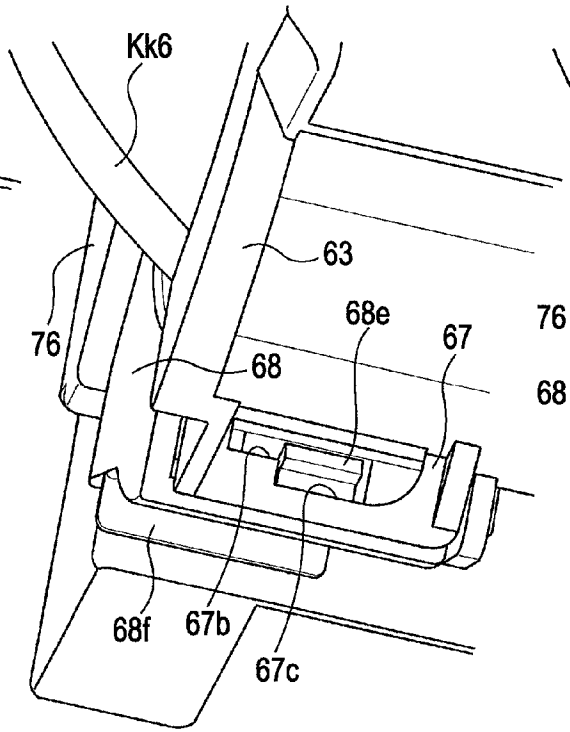
Figure 27C:
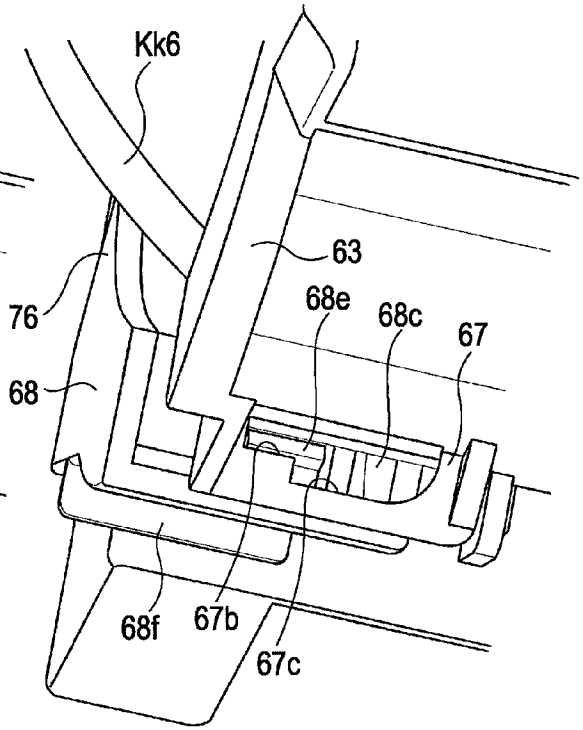

FIGS. 27A to 27C are views in the direction of arrow XXVII of FIG. 25, in which FIG. 27A illustrates a state in which the rotation liming member is in a limiting position and in a movement limiting position, FIG. 27B illustrates a state in which the rotation liming member is in the limiting position and in a movement limitation released position, and FIG. 27C illustrates a state in which the rotation liming member is in an allowance position.

Referring to FIGS. 26A to 27C, at the left end of the rib contact portion 63*c*, a lock portion 67 is formed. The lock portion 67 has a plate-like shape and extends rearward. The lock portion 67 is an example of a movement limiting member. The lock opening 67 is formed in the lock portion 67. The lock opening 67*a* is an example of a limiting engagement portion. In the first example, the lock opening 67*a* includes an engagement allowing portion 67*b* and an allowance limitation portion 67*c*. The engagement allowing portion 67*b* extends in the front-rear direction along the front end portion. The allowance limitation portion 67*c* is formed in the rear end of the engagement allowing portion 67*b* so as to extend downward in a step-like shape.

Referring to FIGS. 16 and 23 to 26, a rotation lock member 68 is supported on the rotation limiting mount portion 63*a*1 of the front end wall 63. The rotation lock member 68 is an example of a rotation liming member. Referring to FIGS. 26A and 26B, the rotation lock member 68 according to the first example includes a lock front wall 68*a* extending along the opening 63*a* in the front end wall 63. A lock bottom wall 68*b* having a plate-shape is integrally formed with a lower end portion of the lock front wall 68*a* so as to extend rearward. The right upper surface of the of the lock bottom wall 68*b* is an arm urging surface 68*b*1. The arm urging surface 68*b*1 is an example of an arm supporting body.

At the rear end of the lock bottom wall 68*b*, a lock rear wall 68*c* is formed so as to extend upward. At the left end of the lock rear wall 68*c*, a spring mounting protrusion 68*d* is formed so as to correspond to the spring mounting protrusion 63*d*. The spring mounting protrusion 68*d* is an example of an urge mount portion.

Referring to FIGS. 26B and 27, at the right end of the lock bottom wall 68*b*, a lock claw 68*e* is formed so as to correspond to the lock opening 67*a* and so as to be engageable with the lock opening 67*a*. The lock claw 68*e* is an example of a movement limiting portion.

Referring to FIGS. 26A to 27C, on a lower left surface of the lock bottom wall 68*b*, a slide protrusion 68*f* is formed so as to extend downward. The slide protrusion 68*f* is an example of a moved portion.

Referring to FIG. 26A, a coil spring 69 is disposed between the spring mounting protrusions 63*d* and 68*d*. The coil spring 69 is an example of a limitation urging member. The coil spring 69, which is a compression spring, urges the spring mounting protrusion 68*d* of the lock member 68 rearward. The coil spring 69 according to the first example includes arms 69*a* and 69*b* at the ends in the front-rear direction. The arms 69*a* and 69*b* are examples of an arm portion. The front arm 69*a* is supported on the arm hook protrusion 63*e*. The rear arm 69*b* contacts the arm urging surface 68*b*1 of the lock member 68 and urges the arm urging surface 68*b*1 downward. That is, the coil spring 69 according to the first example has a function as a normal coil spring that urges the lock member 68 rearward and a function as a torsion spring that urges the arm urging surface 68*b*1 of the lock member 68 downward.

Therefore, the lock member 68 according to the first example is urged rearward by the coil spring 69, and the arm urging surface 68*b*1 is urged downward by the coil spring 69. That is, the coil spring 69 urges the arm urging surface 68*b*1 downward, so that a force that rotates the right side of the lock member 68 downward around the spring mounting protrusions 63*d* and 68*d* is applied to the lock member 68. Therefore, referring to FIGS. 27A to 27C, a force is applied to the lock claw 68*e* so as to move the lock claw 68*e* rearward and downward. As illustrated in FIG. 27A, the lock claw 68*e* engages with the allowance limitation portion 67*c* and is held in a movement limiting position in which a forward movement of the lock member 68 is limited.

Referring to FIG. 25, when the lock member 68 is held in the movement limiting position, the lock front wall 68*a* of the lock member 68 is held in a limiting position in which the lock front wall 68*a* contacts the rotation limiting mount portion 63*a*1 of the front end wall 63. Therefore, the lock member 68 is positioned adjacent to the left side of the rotation limiting piece Kk7 of the toner cartridge Kk that is mounted, and when the toner cartridge Kk is rotated, the lock member 68 contacts the rotation limiting piece Kk7 and limits the rotation.

Figure 28:
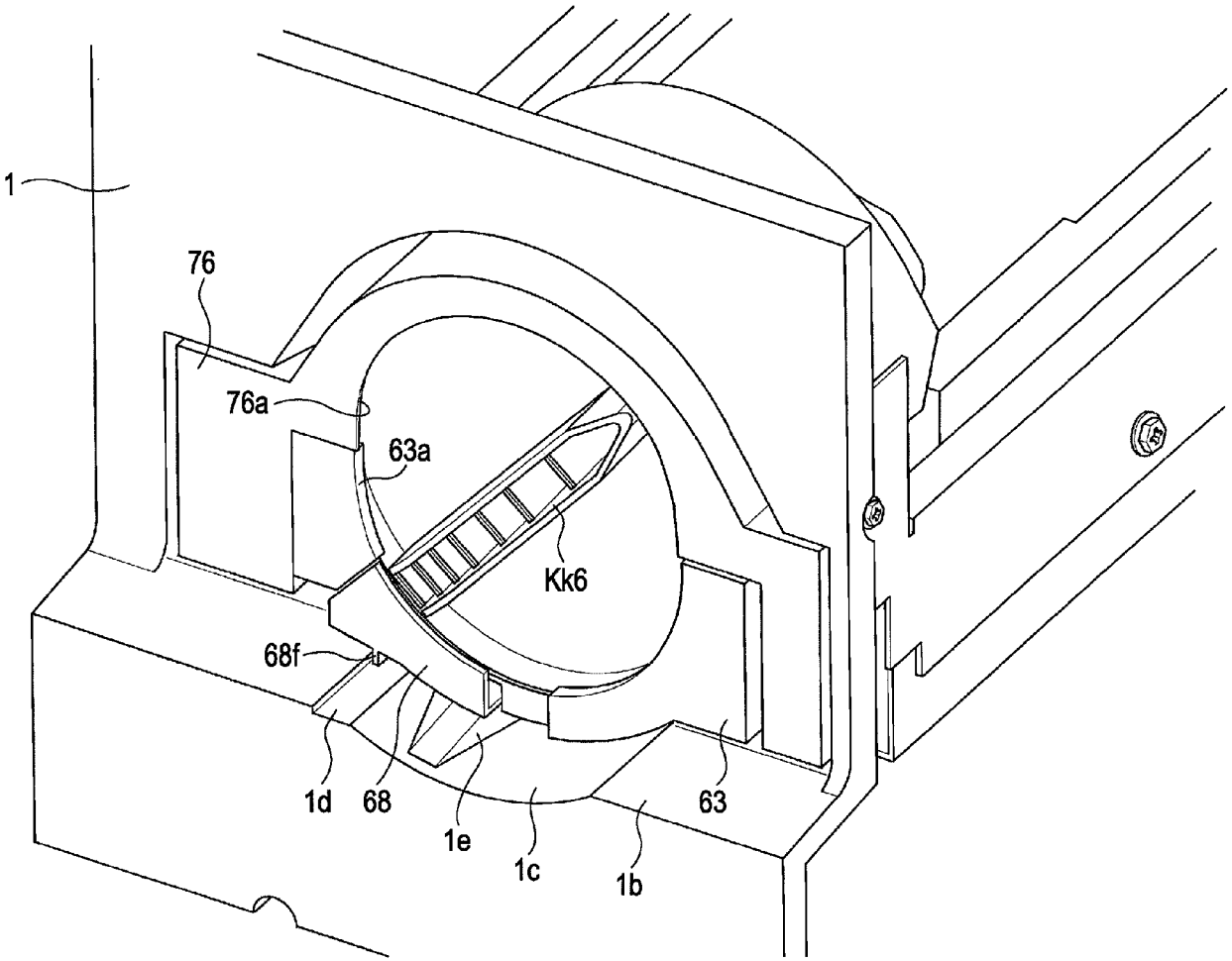
FIG. 28 illustrates a state in which the toner cartridge is in an outlet open position.

FIG. 28 illustrates a state in which the toner cartridge is in an outlet open position.

Referring to FIGS. 3 and 28, in a state in which the cartridge Kk is mounted on the tilt holder 31, when the guided rails 21 and 22 move toward the installed position, a right portion of the lower surface of the lock bottom wall 68*b* contacts the inclined surface 1*e* before the slide protrusion 68*f* contacts the rear end surface of the lock release groove 1*d*. Therefore, as the toner cartridge Kk is inserted, a right portion of the lock bottom wall 68*b* rotates upward along the inclined surface 1*e*. Against the urging force due to the torsion spring function of the coil spring 69, the lock claw 68*e* moves upward from the movement limiting position to the movement limitation released position illustrated in FIG. 27B. Therefore, the lock claw 68*e* is disengaged with the allowance limitation portion 67*c*, and the lock member 68 is allowed to move forward.

Referring to FIGS. 3 and 28, when the toner cartridge Kk moves to the installed position, the slide protrusion 68*f* contacts the rear end surface of the lock release groove 1*d*. At this time, the lock member 68 is moved forward because the lock claw 68*e* has been disengaged with the allowance limitation portion 67*c* and the lock member 68 is allowed to move forward. Therefore, as illustrated in FIG. 27C, the lock claw 68*e* engages with the engagement allowing portion 67*b*, and, as illustrated in FIG. 28, the lock member moves to an allowance position in which a space is provided between the lock front wall 68*a* of the lock member 68 and the rotation limiting mount portion 63*a*1. Therefore, when the lock member 68 is in the allowance position, the lock front wall 68*a* of the lock member 68 does not interfere with the rotation limiting piece Kk7 of the toner cartridge Kk, whereby the toner cartridge Kk is allowed to rotate.

Description of Front Cover

Referring to FIGS. 3 to 7 and 15 to 24, a front cover 71 is supported at the front end of the holder cover 61. The front cover 71 is an example of a front end opening/closing member. Referring to FIGS. 19 to 24, the front cover 71 includes a front cover cylindrical wall 72 having a semi-cylindrical shape, a front cover left wall 73, a front cover right wall 74, and a front cover front wall 76. The front cover left and right walls 73 and 74 respectively extend from the left and right ends of the front cover cylindrical wall 72 along the left and right covers 64 and 66. The front cover front wall 76 is formed at the front end of the front cover cylindrical wall 72 so as to correspond to the front end wall 63.

The front cover left wall 73 and the front cover right wall 74 respectively have cover rotation shafts 77 that extend in the left-right direction and are rotatably supported by the left cover 64 and the right cover 66. Therefore, the front cover 71 according to the first example is supported so as to be rotatable around the cover rotation shafts 77 between a front end closed position illustrated in FIGS. 6, 7, 15, 17, 19, 20, and 24 and a front end open position illustrated in FIGS. 5, 16, 18, 22, and 23.

Referring to FIGS. 16 and 23, at the upper front end of the front cover cylindrical wall 72 in the front end open position, a pair of cartridge guide portions 72*a* are formed to have a shape that matches with the outer surface of the toner cartridge Kk. The cartridge guide portions 72*a* are examples of a guide portion.

In the front end closed position illustrated in FIGS. 17 and 19, lock studs 78 are formed on the front cover left wall 73 and the front cover right wall 74 at positions in front of and below the cover rotation shafts 77 and corresponding to the lock openings 56 in the supports 46 and 47. The lock studs 78 are examples of a rotation linking portion. The lock studs 78 are inserted into and connected to the lock openings 56 in such a manner that the lock studs 78 are movable in the lock opening 56 when the front cover 71 rotates or when the supports 46 and 47 rotate.

An opening 76*a* is formed in the cover front wall 76. The opening 76*a* corresponds to the opening 63*a* in the front end wall 63 and has a diameter that is smaller than the outer diameter of the toner cartridge Kk.

Thus, the front end wall 63 of the holder cover 61 and the cover front wall 76 of the front cover 71 constitute a pull-out limiting member (63+76) that limits forward movement of the toner cartridge Kk and prevents the toner cartridge Kk from being dropped when the tilt holder 31 is tilted.

Operation of First Example

When the image forming apparatus U according to the first example the present invention having the structure described above performs image formation (job) and developer is consumed by the developing units GG to GK, the toner dispenser unit U3*a* operates so as to supply developer from the toner cartridges Kg to Kk in accordance with consumption of the toner. When the developer in the toner cartridges Kg to Kk is exhausted, the toner cartridges Kg to Kk are replaced.

Description of Operation of Removing Toner Cartridge

Referring to FIG. 3, when replacing the toner cartridge Kk that has been emptied, in the installed position illustrated in FIG. 3, the cartridge handle Kk6 of the toner cartridge Kk is operated so as to rotate the toner cartridge Kk from the outlet open position illustrated in FIG. 10C to the outlet closed position illustrated in FIG. 10A. As the toner cartridge Kk rotates, the cartridge shutter Kk4 and the body-side shutter 12 rotates, and the outlet Kk3 and the inlet 9 are closed.

While the toner cartridge Kk moves from the inlet 9 to the position of the cartridge shutter Kk4, the outlet Kk3 passes in a state in which the outlet Kk3 faces the upper surface of the inlet forming portion 7. At this time, developer may be spilled through the outlet Kk3 and may adhere to the upper surface of the inlet forming portion 7.

Figure 29:
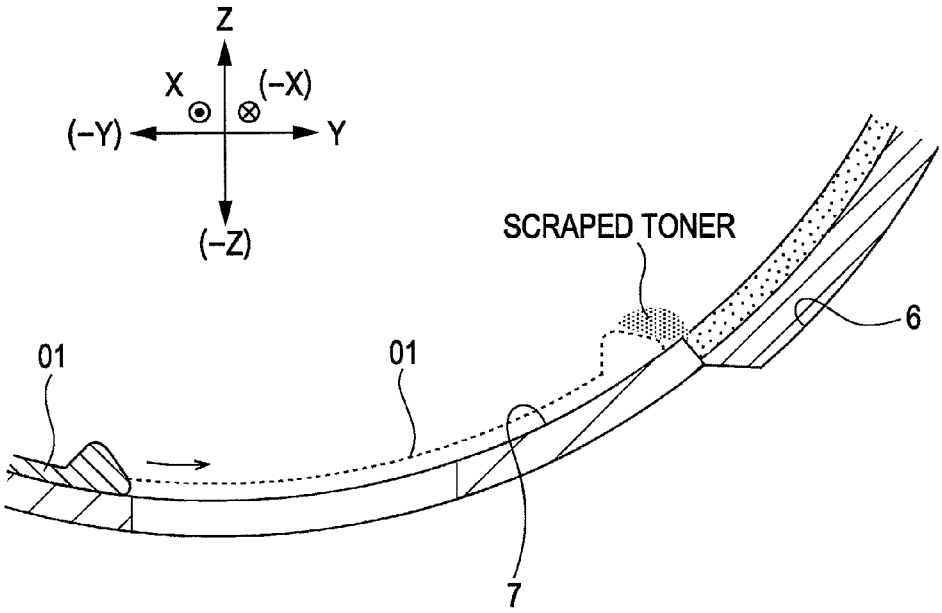
FIG. 29 illustrates an existing cartridge shutter.

FIG. 29 illustrates an existing cartridge shutter.

Referring to FIG. 29, the push-up portion 12*f* is not formed in an existing body-side shutter 01. With such a structure, when the body-side shutter 01 moves rightward, the right end of the body-side shutter 01 scrapes developer that has adhered to the inlet forming portion 7. The scraped developer overflows from the right end of the inlet forming portion 7 to the shutter passage groove 6, so that the shutter passage groove 6 is contaminated. The overflowed developer adheres to the toner cartridge Kk that is inserted next time. Every time the toner cartridge Kk is replaced, developer that adheres to the toner cartridge Kk may be dropped outside the image forming apparatus U or a user's hand may be smeared.

In contrast, the push-up portion 12*f* is formed in the body-side shutter 12 according to the first example. When the body-side shutter 12 moves to the closed position of the inlet 9, the scrape limiting space 12*g* is provided between the upper surface of the inlet forming portion 7 and the body-side shutter 12. Thus, scraping of the developer on the upper surface of the inlet forming portion 7 is suppressed. Therefore, overflowing of the developer and contamination of the inside and the outside of the image forming apparatus U are suppressed.

According to the first example, the position of the outlet Kk3 of the toner cartridge Kk is disposed inside the width of the inlet 9 with respect to the front-rear direction when the front end of the outlet portion Kk2 contacts the front end of the shutter guide 11, and the path of the outlet Kk3 when the toner cartridge Kk moves toward the outlet closed position is within the scrape limiting space 12*g*. Therefore, when the body-side shutter 12 moves, scraping of the developer by the ribs 12*h*, which are front and rear edges of the push-up portion 12*f*, is reduced.

According to the first example, the developer pocket 6*a* is formed, so that overflowed developer is contained in the developer pocket 6*a* and contamination inside and outside the image forming apparatus U is reduced.

According to the first example, in the closed position of the inlet 9, the counter portion 12*e* of the body-side shutter 12 is disposed at a position in front of the shutter pressing portion 8, and there is a small space between the counter portion 12*e* and the toner cartridge Kk. Therefore, overflowing of developer that is pushed by the right end surface of the shutter 12 into the shutter passage groove 6 is reduced, and contamination inside and outside of the image forming apparatus U is reduced.

When the toner cartridge Kk rotates to the outlet closed position, the outlet portion Kk2 moves to the shutter passage groove 6, and the toner cartridge Kk, the guided rails 21 and 22, and the tilt holder 31 are allowed to be pulled out forward. After the cartridge handle Kk6 is operated and the toner cartridge Kk is pulled out forward from the installed position, while the toner cartridge Kk moves from the installed position illustrated in FIG. 3 toward the pulled-out position illustrated in FIG. 4, the slide protrusion 68*f* of the lock member 68 becomes disengaged from the lock release groove 1*d*, and the lower surface of the lock bottom wall 68*b* becomes separated from the inclined surface 1*e*. Therefore, due to an elastic force of the coil spring 69, the lock claw 68*e* of the lock member 68 moves from the allowance position in which the lock claw 68*e* engages with the engagement allowing portion 67*b* to the movement limiting position in which the lock claw 68*e* engages with the allowance limitation portion 67*c*. Therefore, the lock member 68 interferes with the rotation limiting piece Kk7, and the rotation of the toner cartridge Kk becomes limited. As a result, rotation of the toner cartridge Kk during pull-out operation is reduced, and the operability is improved.

Referring to FIGS. 3 and 4, the toner cartridge Kk that has been pulled out forward from the installed position illustrated in FIG. 3 may be pulled out to the pulled-out position illustrated in FIG. 4 in which the stoppers 24 of the guided rails 21 and 22 contact the screws 19 of the guide rails 16. As illustrated in FIG. 15, in the pulled-out position, the latches 42*d* are fitted into the latch holes 51 in the supports 46 and 47, and the tilt holder 31 is held in the insertable position illustrated in FIGS. 4 and 15.

Referring to FIGS. 17 and 19, in the pulled-out position, the lock stud 78 of the front cover 71 is fitted into the cover lock portion 56*c* of the lock opening 56. Therefore, in the insertable position illustrated in FIGS. 4, 15, and 17, the front cover 71 is non-rotatably held in the front end closed position illustrated in FIG. 17. Therefore, in the insertable position, the front cover 71 is prevented from being mistakenly moved to the front end open position and opened. Therefore, an accident such that the tilt holder 31 is rotated when the front cover 71 is rotatable and the toner cartridge Kk slips out of the tilt holder 31 is prevented.

When a user moves down the cartridge handle Kk6 at the front end of the toner cartridge Kk that is held in the insertable position, the latch 42*d* is pulled out of the latch hole 51 against the elastic force of the pin urging spring 43, and the toner cartridge Kk starts to move down toward the tilt position.

In the tilt holder 31 according to the first example, the holder rotation shaft 32 includes the one-way hinge 38, so that torque is transmitted only when the torque is larger than the free-rotation toque. Therefore, if the one-way hinge 38 is not provided, the toner cartridge Kk may rotate downward too fast toward the tilt position due to the weight of the toner cartridge Kk and the tilt holder 31. As a result, the tilt holder 31 rotating at high speed may collide with and break something or the toner cartridge Kk may pop out. According to the first example, the one-way hinge 38 reduces the rotation speed, whereby the probability of such an accident is reduced.

When the tilt holder 31 rotates toward the tilt position, the supports 46 and 47, which are connected with the tilt holder 31 with the support connection studs 44, rotate around the support rotation shaft 48 that is disposed at a position separated from the holder rotation shaft 32. When the tilt holder 31 and the supports 46 and 47 rotate, as illustrated in FIGS. 17, 19, and 20, the support connection studs 44 relatively moves along the guide groove 53 of the tilt stop groove 52 in accordance with the difference in the rotation path of the tilt holder 31 and the rotation paths of the supports 46 and 47 whose rotation shafts 32 and 48 are disposed so as to be offset from each other. As illustrated in FIG. 20, when support connection studs 44 contact the downward rotation lock surface 53*b* at the front end of the guide groove 53, the rotation of the tilt holder 31 and the rotation of the supports 46 and 47 are limited, and a further downward tilt is limited. That is, movement of the tilt holder 31 to the tilt position illustrated in FIGS. 5 and 20 is finished, and the supports 46 and 47 are moved to a lower rotation position.

When the tilt holder 31 rotates, in the front cover 71, which rotates together with the tilt holder 31, the lock stud 78 moves relative to the lock opening 56 at the front end of each of the supports 46 and 47 that rotates along the path that is different from the rotation path of the tilt holder 31. The state of the lock stud 78 changes from the state in which the lock stud 78 is fitted into the cover lock portion 56*c* illustrated in FIG. 19 to the state in which the lock stud 78 contacts the support lock release portion 56*b* illustrated in FIG. 20. Therefore, when the tilt holder 31 has moved to the tilt position illustrated in FIG. 20, the front cover 71 is rotatable around the cover rotation shaft 77.

Referring to FIGS. 12 and 13, as the tilt holder 31 rotates, the link 27 connected to the link connection pin 36*d* on the right side rotates in association with the tilt holder 31, and the link 27 moves from the stopper separation position illustrated in FIG. 12 to the stopper contact position illustrated in FIG. 13. Therefore, the stopped portion 27*b* contacts the misinsertion stop portion 16*a*, and movement of the guided rails 21 and 22 toward the installed position is limited. Therefore, while the tilt holder 31 is being tilted or while the toner cartridge Kk is being replaced, movement of the guided rails 21 and 22, the tilt holder 31, and the like toward the installed position is suppressed.

In the tilt holder 31 according to the first example, the support rotation shafts 48 of the supports 46 and 47 are disposed in the vicinities of the holder rotation shafts 32, the amounts by which the guided rails 21 and 22 protrude forward are reduced. Therefore, with the cartridge holder KHk according to the first example, the probability of an accident such that the protruding guide rails 21 and 22 contact and injure an operator is reduced as compared with a cartridge holder in which the guided rails protrude forward by a large amount.

Because the support rotation shaft 48 and the holder rotation shaft 32 are close to each other, the rotation path of the tilt holder 31 is similar to the rotation paths of the supports 46 and 47. Therefore, in the tilt position, the displacements of the supports 46 and 47 from the tilt holder 31 are small, and the supports 46 and 47 protrude by a small amount from the lower surface of the tilt holder 31. Thus, the probability of an accident such that the protruding supports 46 and 47 contact and injure an operator is reduced.

In the tilt position, when the front cover 71 is rotated from the front end closed position illustrated FIG. 5 to the front end open position illustrated in FIG. 6, the lock stud 78 rotates along the cover stud guide groove 56*a* of the lock opening 56. When the lock stud 78 is separated from the support lock release portion 56*b* and moves to the cover stud guide groove 56*a*, the supports 46 and 47 rotate. Then, as illustrated in FIGS. 18 and 21, the supports 46 and 47 move to a rotation limiting position in which the support connection stud 44 is fitted into the rotation lock surface 54*a* from the downward rotation lock surface 53*b*. In this state, rotation along the guide groove 53 is limited. As a result, the supports 46 and 47 are held in a non-rotatable state in which the tilt holder 31 is non-rotatable from the tilt position toward the insertable position. Therefore, when the front cover 71 is open, the tilt holder 31 is prevented from mistakenly rotated toward the insertable position.

When the front cover 71 moves to the front end open position illustrated in FIG. 6, the toner cartridge Kk may be removed from the tilt holder 31 illustrated in FIG. 7. Therefore, with the image forming apparatus U according to the first example, when mounting and removing the toner cartridges Kg to Kk, which are disposed in an upper part of the image forming apparatus U, a short-statured operator or an operator using a wheelchair may easily replace the toner cartridges Kg to Kk, as compared with existing structures in which, in contrast to the tilt holder 31, the toner cartridge is movable only in the front-rear directions and may not be tilted.

Description of Operation of Mounting Toner Cartridge

Figures 30A, 30B, 30C:
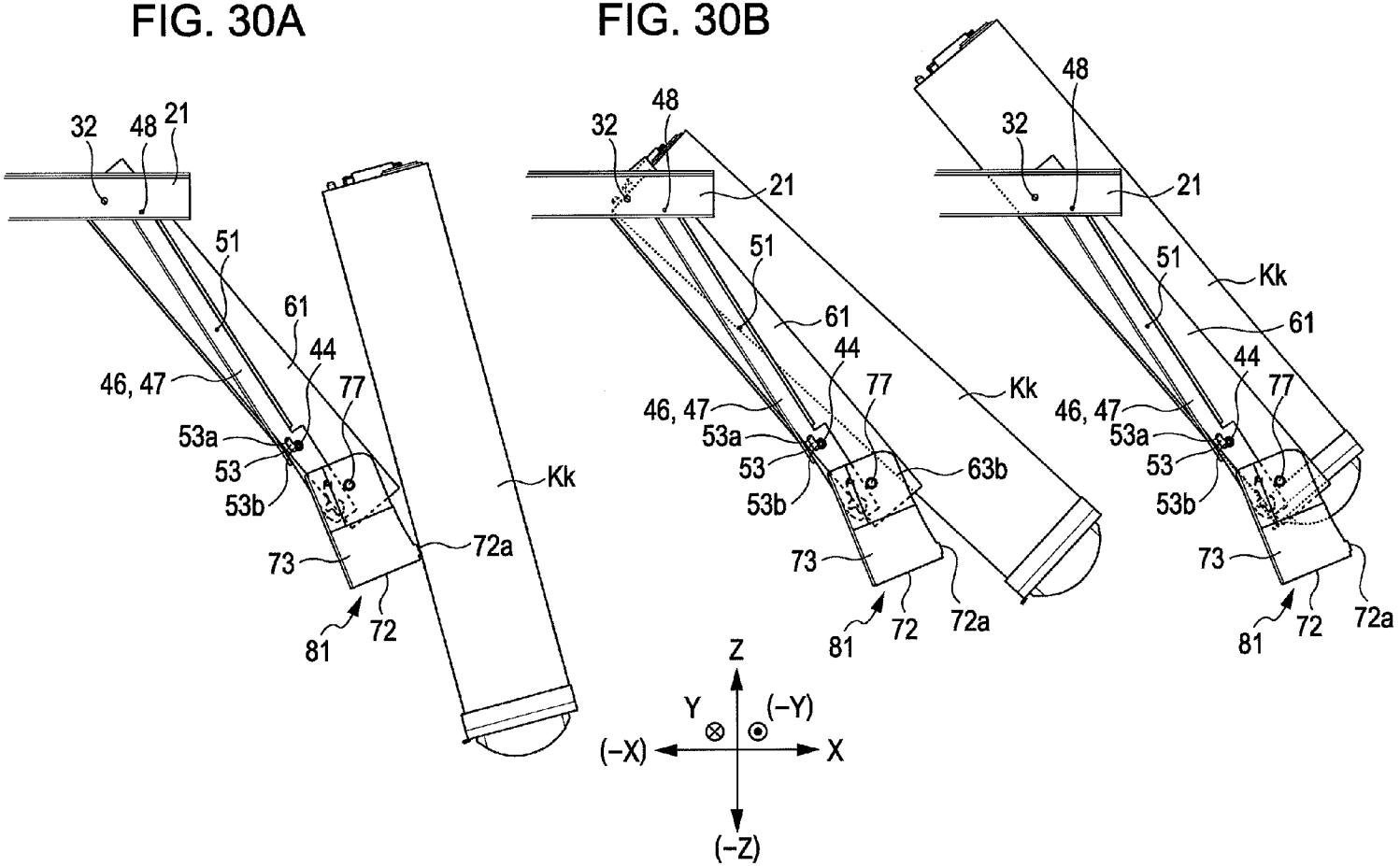

FIGS. 30A to 30C illustrate the operation of mounting the toner cartridge on the holder, in which FIG. 30A illustrates a state in which the toner cartridge is made to contact the front cover from below, FIG. 30B illustrates a state in which the toner cartridge is being tilted and pushed upward from the state illustrated in FIG. 30A, and FIG. 30C illustrate a state in which the toner cartridge has been mounted on the holder.

Referring to FIGS. 7, 30A to 30C, and 31A and 31B, an operator usually mounts a new toner cartridge Kk by pushing the toner cartridge from below. This is because, if the operator tries to lift the toner cartridge Kk and mount the toner cartridge Kk from above the tilt holder 31, which is inclined from the upper part of the image forming apparatus U, a lifting force is necessary or an it is difficult for a short-statured operator. Therefore, as illustrated in FIG. 30A, when mounting the toner cartridge Kk on the tilt holder 31, an outer surface of the toner cartridge Kk is first made to contact the cartridge guide portion 72*a* of the front cover 71.

Figure 31B:
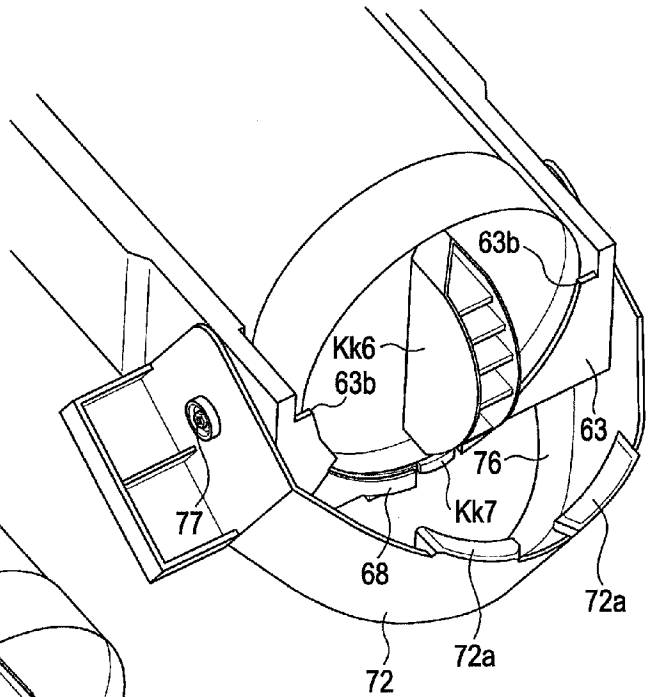
FIGS. 31A and 31B illustrate the operation of mounting the toner cartridge on the holder, in which FIG. 31A corresponds to FIG. 30B and illustrates a state in which the toner cartridge is being pushed upward, and FIG. 31B corresponds to FIG. 30C and illustrates a state in which the toner cartridge has been mounted on the holder.
Figure 31A:
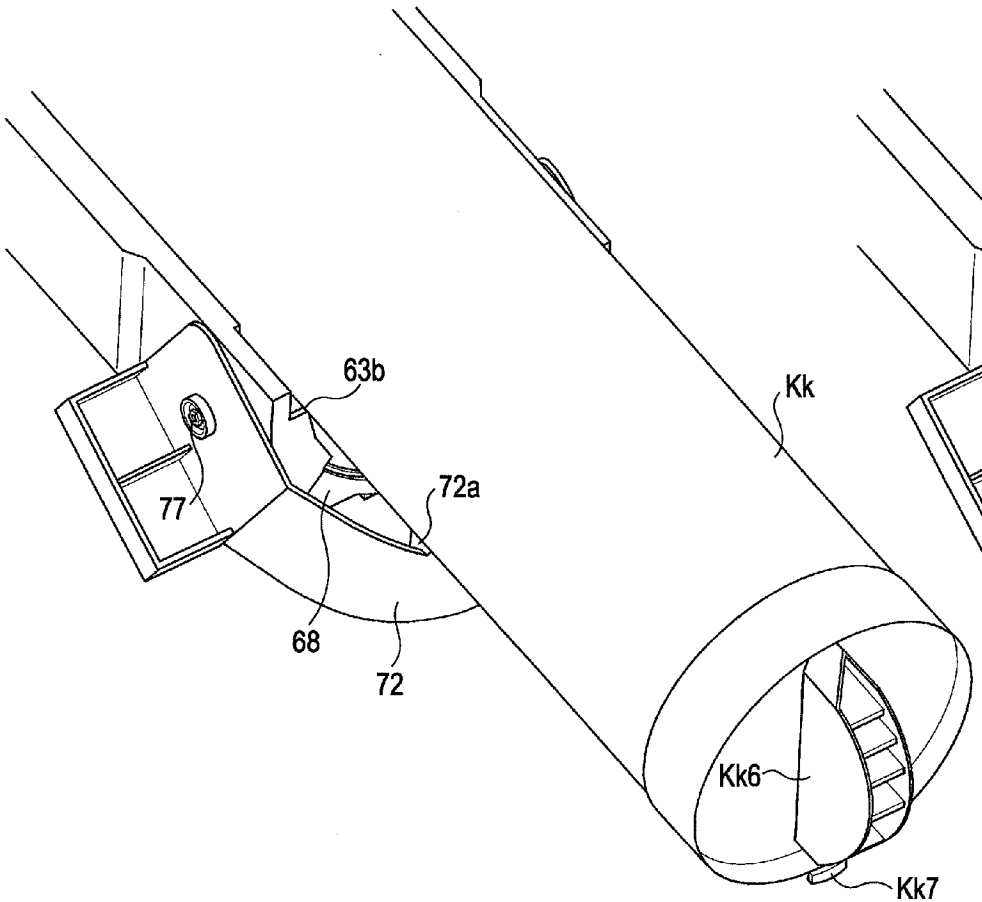

FIGS. 31A and 31B illustrate the operation of mounting the toner cartridge on the holder, in which FIG. 31A corresponds to FIG. 30B and illustrates a state in which the toner cartridge is being pushed upward, and FIG. 31B corresponds to FIG. 30C and illustrates a state in which the toner cartridge has been mounted on the holder.

Next, the toner cartridge Kk is pushed upward along the cartridge guide portion 72*a* and rotated to be in the state illustrated in FIGS. 30B and 31A. In this state, the toner cartridge Kk is guided upward in accordance with the tilt angle of the toner cartridge Kk while the outer surface of the toner cartridge Kk is in contact with one or both of the cartridge guide portion 72*a* and the guide corner 63*b*. Therefore, the toner cartridge Kk may be easily mounted as compared with a structure that does not include the cartridge guide portion 72*a* and the guide corner 63*b*.

In the first example, the outer surface of the toner cartridge Kk is supported by the guide corner 63*b* at the upper end of the front end wall 63, so that damage to the front end wall 63, which may be caused due to contact with a portion that protrudes downward, such as the rotation limiting piece Kk7 of the toner cartridge Kk, is reduced.

When the front end of the toner cartridge Kk moves to a position in the rear of the front end wall 63, the toner cartridge Kk has been inserted into and mounted on the tilt holder 31.

Therefore, the new toner cartridge Kk is mounted on the cartridge holding surface 62*a* to be in the state illustrated in FIG. 6. As illustrated in FIG. 6, when the front cover 71 is in the front end open position, the rotation lock surface 54*a* is in contact with the support connection stud 44, so that the tilt holder 31 is non-rotatable. Moreover, the stopped portion 27*b* of the link 27 is in contact with the misinsertion stop portion 16*a*, so that the tilt holder 31 cannot be inserted. Therefore, the tilt holder 31 is prevented from being rotated or inserted when the front cover 71 is mistakenly left unclosed.

Referring to FIGS. 5 and 6, when the front cover 71 is rotated toward the front end closed position, the front cover 71 passes through the state illustrated in FIG. 21 to the front end closed position illustrated in FIG. 20. In the front end closed position illustrated FIG. 20, the support connection stud 44 is in contact with the downward rotation lock surface 53*b*, and the supports 46 and 47 become rotatable upward. Also in this state, the stopped portion 27*b* of the link 27 is in contact with the misinsertion stop portion 16*a*, and the guided rails 21 and 22 cannot be inserted.

When the front cover 71 moves to the front end closed position, the lock member 68 is held in the movement limiting position due to an elastic force by the coil spring 69, and the rotation limiting piece Kk7 of the toner cartridge Kk is sandwiched between the lock member 68 and the front end wall 63, so that rotation is limited. Therefore, while an operator is holding the cartridge handle Kk6, a misoperation such that the cartridge Kk is rotated relative to the tilt holder 31 and an unintentional operation is performed is reduced.

The lock member 68 is held in the movement limiting position, and the lock claw 68*e* engages with the allowance limitation portion 67*c*, whereby forward movement is limited. Therefore, even if a force for rotating the toner cartridge Kk is applied, the lock member 68 is prevented from pushed forward, so that unintentional rotation of the toner cartridge Kk is reduced as compared with a case in which the allowance limitation portion 67*c* is not provided.

Referring to FIGS. 4 and 5, when the tilt holder 31 is rotated upward from the tilt position illustrated in FIG. 5, the tilt holder 31 moves to the insertable position illustrated in FIG. 4. At this time, the one-way hinge 38, which is included in the holder rotation shaft 32 according to the first example, does not limit torque in the rotation direction from the tilt position toward the insertable position. Therefore, when an operator rotates the tilt holder 31 upward from below, a load against a rotation force applied by the operator is not generated, so that the operator may easily rotate the tilt holder 31 to the insertable position as compared with the case in which a brake member that limit torque in both rotation directions. If the operator mistakenly release the tilt holder 31 while lifting the tilt holder 31 to the insertable position, torque from the insertable position toward the tilt position is limited, so that rapid drop is prevented, whereby injury of an operator or other accidents are reduced.

In the tilt holder 31 according to the first example, the rear end protection portion 64*a* of the left cover 64 occupies the space between the left side wall 36*b* and the left guided rail 21, so that the probability of an accident such that an operator's finger is mistakenly caught between the guided rail 21 and the left cover 64 during operation is reduced.

When the tilt holder 31 is in the insertable position illustrated in FIG. 4, the latches 42*d* are fitted into the latch hole 51 in the supports 46 and 47 as illustrated in FIGS. 15A and 15B, so that an operator may recognize that the tilt holder has moved to the insertable position. Even if the operator tries to rotate the tilt holder 31 further upward from the insertable position, as illustrated in FIGS. 15 and 17, the support connection stud 44 is in contact with the upward rotation lock surface 53*a* of the guide groove 53. Therefore, upward rotation of the supports 46 and 47 is limited, and the upward rotation of the tilt holder 31 above the insertable position is limited.

Moreover, in the insertable position, the lock stud 78 of the front cover 71 is fitted into the cover lock portion 56*c*, so that the front cover 71 is prevented from mistakenly opened to be in the front end open position.

In the insertable position, the link 27 is in the stopper separation position illustrated in FIG. 12, the stopped portion 27*b* is separated from the misinsertion stop portion 16*a*, and the guided rails 21 are 22 movable rearward toward the installed position.

Referring to FIGS. 3 and 4, when a user pushes the cartridge handle Kk6 from the insertable position illustrated in FIG. 4, the rotation limiting piece Kk7 of the cartridge Kk contacts the rotation limiting mount portion 63*a*1 of the upper cover 62 as illustrated in FIG. 24, and the toner cartridge Kk, the tilt holder 31, and the guided rails 21 and 22 move rearward toward the installed position illustrated in FIG. 3.

At this time, the toner cartridge Kk according to the first example is held in a non-rotatable state in which the rotation limiting piece Kk7 interferes with the lock member 86 and the outlet portion Kk2 is at a position corresponding to the shutter passage groove 6. Therefore, the outlet portion Kk2 does not interfere with the toner cartridge Kk and the toner cartridge Kk is movable through the shutter passage groove 6 toward the installed position.

Referring to FIG. 21, when the tilt holder 31 moves from the insertable position toward the installed position and the right portion of the lower surface of the lock bottom wall 68*b* of the lock member 68 contacts the inclined surface 1*e*, the lock claw 68*e* moves from the movement limiting position to the movement limitation released position against the urging force by the torsion spring function of the coil spring 69 as illustrated in FIG. 27B, and the lock member 68 becomes movable forward. When the tilt holder 31 and the like are inserted further to the installed position, the slide protrusion 68*f* contacts the rear end surface of the lock release groove 1*d*, the lock claw 68*e* engages with the engagement allowing portion 67*b* as illustrated in FIG. 27C, and the tilt holder 31 and the like are held in a state in which there is a space between the lock front wall 68*a* of the lock member 68 and the rotation limiting mount portion 63*a*1 as illustrated in FIG. 28.

Therefore, the toner cartridge Kk is rotatable relative to the tilt holder 31 by operating the cartridge handle Kk6.

Referring to FIG. 3, when the cartridge handle Kk6 is rotated in the state in which the tilt holder 31 is in the installed position and rotation of the toner cartridge Kk is allowed, the toner cartridge Kk moves from the outlet closed position illustrated in FIG. 10A to the outlet open position illustrated in FIG. 10C, and the outlet Kk3 and the inlet 9 are opened and connected to each other. Therefore, developer may be supplied from the toner cartridge Kk to the reserve tank RTk.

SECOND EXAMPLE

Figure 32:
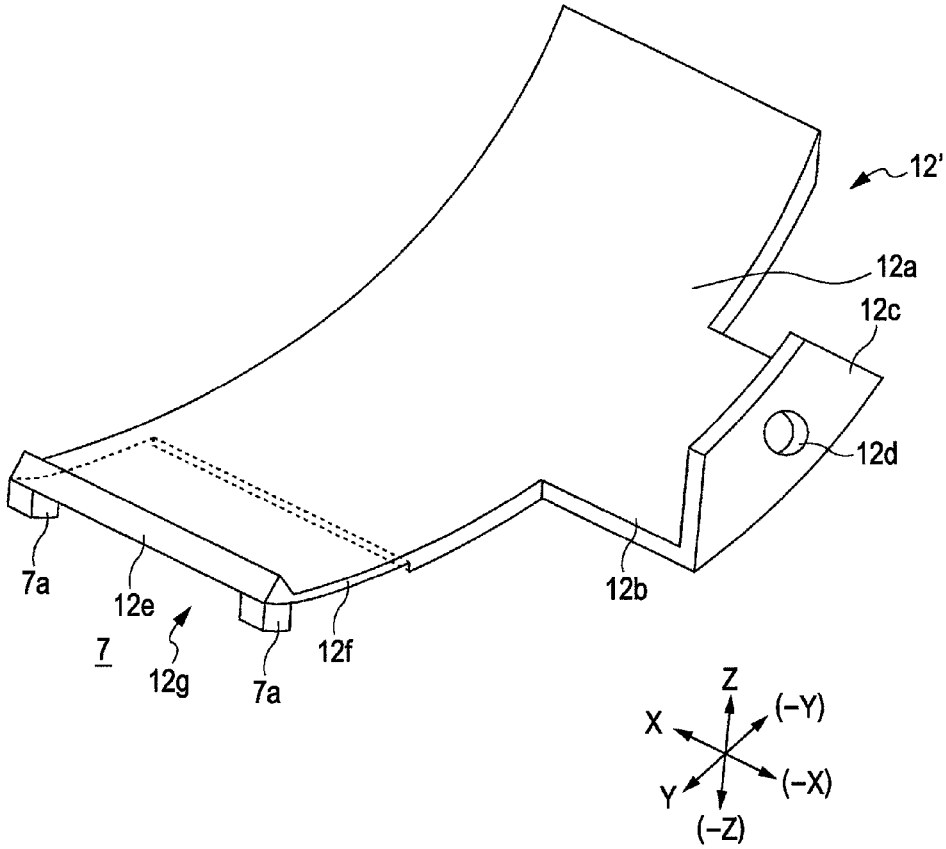
FIG. 32 illustrates a body-side shutter according to a second example and corresponds to FIG. 11 for the first example.

FIG. 32 illustrates a body-side shutter according to a second example and corresponds to FIG. 11 for the first example.

In the following description of the second example of the present invention, structural elements that are the same as those of the first example are denoted by same numerals and detailed description of such elements will be omitted.

The second example is the same as the first example except for the following points.

Referring to FIG. 32, the rib 12*h*, which is included in the body-side shutter 12 according to the first example, is omitted from the body-side shutter 12' according to the second example. Instead of the rib 12*h*, a pair of guide ribs 7*a* are formed on the inlet forming portion 7 so as to protrude toward the push-up portion 12*f*. The guide ribs 7*a* are examples of a protrusion. In the second example, the width of the push-up portion 12*f* in the left-right direction, the positions and the size of the guide ribs 7*a* are determined so that movement of the body-side shutter 12' between the outlet open position and the outlet closed position is not interrupted.

Operation of Second Example

With the image forming apparatus U according to the second example including the structure described above, the body-side shutter 12' moves in a state in which the scrape limiting space 12*g* is provided between the push-up portion 12*f* of the body-side shutter 12' and the inlet forming portion 7. Therefore, when the body-side shutter 12' moves to the outlet closed position, scraping of the developer that has adhered to a surface of the inlet forming portion 7 by the body-side shutter 12' is suppressed.

Modification

The present invention is not limited to the examples that have been described above, and may be modified in various ways within the spirit and scope described in the claims. Modifications (H01) to (H019) according to the present invention will be described below in detail.

(H01) In the examples described above, the image forming apparatus U is a so-called multifunctional apparatus. However, the examples are not limited thereto, and may be applied to, for example, a printer, a facsimile machine, and the like.

(H02) In the examples described above, the image forming apparatus U uses toner of six colors. However, the example are not limited thereto, and the number of colors may be smaller than or larger than six.

(H03) In the examples described above, toner of green (G), orange (O), yellow (Y), magenta (M), cyan (C), black (K) is used. However, the example are not limited thereto, and, for example, toner of green (G) and orange (O) may be replaced with toner of other colors. Moreover, clear toner for coating the surface of an image for waterproofing and protection, toner of a color that signifies a company or an organization (so-called corporate color), and magnetic toner for forming a magnetic wire that is preset in an image on a printing sheet for antitheft purposes. The magnetic wire may have a predetermined arrangement and shape, such as a linear shape. An antitheft device that detects a magnetic pulse generated by the magnetic wire is described, for example, in Japanese Unexamined Patent Application Publication No. 2006-256124, and is well-known.

(H04) In the examples described above, the one-way hinge was uses as an example of a brake member. Although it is desirable to use the use of one-way clutch, for example, a torque limiter that limits torque in normal and reverse directions may be used. Alternatively, a device whose load resistance increases with speed (so-called damper) may be used as the brake member. Although it is desirable to use the brake member, the brake member may be omitted.

(H05) In the examples described above, the guided rails 21 and 22 having a rail-like shape are used as examples of a pull-out body. However, the example are not limited thereto, an existing structure that is movable in a pull-out direction (so-called slider and the like) may be used.

(H06) In the examples described above, when mounting the toner cartridges Kk to Kg on the tilt holder 31, the rotation position may be displaced from the outlet closed position toward the outlet open position. In order to prevent this, a mechanism that rotates the toner cartridges Kk to Kg to the outlet closed position when the front cover 71 is closed may be included. For example, a cam may be provided to the handle lock so as to be contact the front end of the toner cartridges Kk to Kg and rotate the toner cartridges Kk to Kg, so that the toner cartridges Kk to Kg may be moved to the outlet closed position in accordance with the operation of closing the front cover 71.

(H07) In the examples described above, the link 27 may be provided so that the guided rails 21 and 22 may be held in the pulled-out position in the state when the tilt holder 31 is not in the insertable position. Although it is desirable to use the link 27, the link 27 may be omitted.

(H08) In the examples described above, the latch 42*d* may be engageable with the latch hole 51, so that an operator may recognize that the tilt holder 31 has moved to the insertable position and holding of the tilt holder 31 at the insertable position may be supported. Although is it desirable to use the latch 42*d* and the latch hole 51, the latch 42*d* and the latch opening 51 may be omitted. Instead of the combination of the pin 42 and the latch hole 51, for example, a combination of a lock claw and a hole, a combination of a lock claw and a pin, or an appropriate existing structure may be used. The pin 42 is formed on the holder frame 36 and the latch hole 51 is formed in each of the supports 46 and 47. However, the latch hole may be formed in the holder frame 36, and a pin may be formed on each of the supports.

(H09) In the examples described above, the structure may be used in which the supports 46 and 47 rotates in association with the front cover 71, and thereby the support connection stud 44 is fitted into the rotation lock surface 54*a*, and the tilt holder 31 cannot be rotated unless the front cover 71 is in the front end closed position. Although it is desirable to use such a structure, the structure may be omitted.

(H010) In the examples described above, the rotation limiting piece Kk7 contacts the rib contact portion 63*c*, and the toner cartridge Kk is movable from the pulled-out position to the installed position by operating the cartridge handle Kk6. However, the cartridge Kk may be pushed in by using any appropriate structure. For example, the front end of the toner cartridge Kk may be completely covered with the front cover 71 including an operation portion so that the toner cartridge Kk may be pushed toward the installed position by pushing the front cover 71.

(H011) In the examples described above, the holder cover 61 may be omitted, or positions of the holder cover 61 may be formed on the holder frame 36.

(H012) In the examples described above, the rotation of the front cover 71 and the rotation of the supports 46 and 47 are linked by using the lock stud 78 and the lock opening 56. Although it is desirable to use such a structure, this structure may be omitted and the front cover 71 and the supports 46 and 47 may move independently. Instead of the combination of the stud 78 and the opening 56, any linking mechanism may b used. The studs 78 may be formed on the supports 46 and 47, and the opening may be formed in the front cover.

(H013) In the examples described above, the shape and the structure of the lock member 68 are not limited to those of the examples, and may be modified in accordance with the design, specifications, and the like. Although it is desirable to use the lock member 68, the lock member 68 may be omitted.

(H014) In the examples described above, the shapes of the guide corner 63*b* and the opening 63*a* are not limited, and these members may have any appropriate shapes. For example, the opening 63*a* may extend in a vertical or diagonal directions in which the cartridge handle Kk6 is guided so that the rotation limiting piece Kk7 is guided to the rotation limiting mount portion 63*a*1. The guide corner 63*b* may be omitted.

(H015) In the examples described above, the shape of the cartridge guide portion 72*a* is not limited to the shapes described in the examples, and may have any appropriate shape. For example, the length of the cartridge guide portion 72*b* in the left-right direction may be increased, the height may be increased, or may be modified otherwise appropriately. The cartridge guide portion 72*a* may be omitted.

(H016) In the examples described above, the size of the scrape limiting space 12*g*, that is, the width in the front-rear direction and the length in the left-right direction are not limited to those of the examples, and may be any appropriate size. For example, the length of the body-side shutter 12 in the movement direction may be across the entire area of the body-side shutter 12 or may be limited to a vicinity of the counter portion 12*e*.

(H017) In the examples described above, the shape of the developer pocket 6*a* may be appropriately modified in any manner. Although it is desirable to provide the developer pocket 6*a*, the developer pocket 6*a* may be omitted.

(H018) In the examples described above, when the body-side shutter 12 is in the closed position, a small gap is formed on the right side of the counter portion 12*e*. However, the examples are not limited thereto, and the size of the gap may be changed in accordance with the design. Although it is desirable to provide the space, the space may be omitted.

(H019) In the examples described above, the cartridge shutter Kk4 of each of the toner cartridges Kg to Kk moves in the circumferential direction. However, the structure is not limited thereto. For example, the cartridge shutter may be movable in the pull-out direction, and the cartridge shutter may be opened and closed when the toner cartridge moves between the pulled-out position and the installed position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening/closing member that is movable between an open position in which a passage opening through which developer passes is open and a closed position in which the passage opening is closed, the opening/closing member comprising:

protrusions that protrude toward an edge of the passage opening with respect to a scrape limiting portion, each of the protrusions being disposed on one of two sides with respect to a direction that is perpendicular to directions of movement between the open position and the closed position; and a counter portion extending between the protrusions at a front end of the opening/closing member, wherein the front end of the opening/closing member in a closing direction from the open position to the closed position is disposed so as to be separated from a surface of the edge of the passage opening, wherein the opening/closing member seals the passage opening when in the closed position.

2. The opening/closing member according to claim 1, wherein the opening/closing member contacts the edge of the passage opening when in the closed position.

3. A developer supplying apparatus comprising:

a developer container vessel that includes a container that contains developer and a passage opening through which the developer flows out from the container;

an inlet that is connectable to the passage opening and into which the developer flows from the passage opening;

an opening/closing member that is movable between an open position in which the passage opening through which developer passes is open and a closed position in which the passage opening is closed, the opening/closing member including protrusions that protrudetoward an edge of the passage opening with respect to a scrape limiting portion, each of the protrusions being disposed on one of two sides with respect to a direction that is perpendicular to directions of movement between the open position and the closed position, and a counter portion extending between the protrusions at a front end of the opening/closing member, wherein the front end of the opening/closing member in a closing direction from the open position to the closed position is disposed so as to be separated from a surface of the edge of the passage opening; and a transport member that transports the developer that has flowed from the inlet, wherein the opening/closing member seals the passage opening when in the closed position.

4. The developer supplying apparatus according to claim 2, further comprising:

a dropped developer container that is formed at a position in front of the front end of the opening/closing member in the closed position, the front end being with respect to the closing direction, the dropped developer container being capable of containing dropped developer.

5. The developer supplying apparatus according to claim 3, wherein the opening/closing member contacts the edge of the passage opening when in the closed position.

6. A developer supplying apparatus comprising:

a developer container vessel that includes a container that contains developer and a passage opening through which developer flows out from the container;

an inlet that is connectable to the passage opening and into which developer flows from the passage opening;

an opening/closing member that is movable between an open position in which the inlet is open and a closed position in which the inlet is closed;

protrusions that protrude toward an edge of the inlet with respect to a scrape limiting portion, each of the protrusions being disposed on one of two sides with respect to a direction that is perpendicular to directions of movement between the open position and the closed position;

a counter portion extending between the protrusions at a front end of the opening/closing member; and a transport member that transports the developer that has flowed from the inlet, wherein the front end of the opening/closing member in a closing direction from the open position to the closed position is disposed so as to be separated from a surface of the edge of the passage opening.

7. The developer supplying apparatus according to claim 6, wherein the opening/closing member contacts the edge of the passage opening when in the closed position.

8. An image forming apparatus comprising:

an image carrier body;

a developing unit that develops a latent image on a surface of the image carrier body to form a visible image;

a developer container vessel that includes a container that contains developer that is supplied to the developing unit and a passage opening through which the developer flows out from the container;

an inlet that is connectable to the passage opening and into which the developer flows from the passage opening;

an opening/closing member that is movable between an open position in which the inlet is open and a closed position in which the inlet is closed, the opening/closing member including protrusions that protrude toward an edge of the inlet with respect to a scrape limiting portion, each of the protrusions being disposed on one of two sides with respect to a direction that is perpendicular to directions of movement between the open position and the closed position, and a counter portion extending between the protrusions at a front end of the opening/closing member, wherein the front end of the opening/closing member in a closing direction from the open position to the closed position is disposed so as to be separated from a surface of the edge of the passage opening; and a transport member that transports the developer that has flowed from the inlet to the developing unit, wherein the opening/closing member seals the passage opening when in the closed position.

9. The image forming apparatus according to claim 8, wherein the opening/closing member contacts the edge of the passage opening when in the closed position.

10. An image forming apparatus comprising:

an image carrier body;

a developing unit that develops a latent image on a surface of the image carrier body to form a visible image;

a developer container vessel that includes a container that contains developer that is supplied to the developing unit and a passage opening through which the developer flows out from the container;

an inlet that is connectable to the passage opening and into which the developer flows from the passage opening;

an opening/closing member that is movable between an open position in which the inlet is open and a closed position in which the inlet is closed;

protrusions that protrude toward an edge of the inlet with respect to a scrape limiting portion, each of the protrusions being disposed on one of two sides with respect to a direction that is perpendicular to directions of movement between the open position and the closed position;

a counter portion extending between the protrusions at a front end of the opening/closing member; and a transport member that transports the developer that has flowed from the inlet to the developing unit, wherein the front end of the opening/closing member in a closing direction from the open position to the closed position is disposed so as to be separated from a surface of the edge of the passage opening, wherein the opening/closing member seals the passage opening when in the closed position.

11. The image forming apparatus according to claim 10, wherein the opening/closing member contacts the edge of the passage opening when in the closed position.

12. A developer supplying apparatus comprising:

a developer container vessel that includes a container that contains developer and a passage opening through which the developer flows out from the container;

an inlet that is connectable to the passage opening and into which the developer flows from the passage opening; and an opening/closing member that is movable between an open position in which the inlet is open and a closed position in which the inlet is closed, wherein the opening/closing member includes a body that has a push-up portion at a front end of the body in a closing direction from the open position to the closed position and which is disposed so as to be separated from a surface of the edge of the passage opening, and a protrusion that is disposed at an edge of the body in the closing direction from the open position to the closed position, wherein the opening/closing member seals the passage opening when in the closed position.

13. The developer supplying apparatus according to claim 12, wherein the opening/closing member includes a plurality of the protrusions that are disposed on each of two sides of the body with respect to a direction that is perpendicular to a direction of movement between the open position and the closed position.

14. The developer supplying apparatus according to claim 13, wherein the protrusions protrude toward the closing direction from the open position to the closed position.

15. The developer supplying apparatus according to claim 13, wherein the protrusions protrude toward the push-up portion.

16. The developer supplying apparatus according to claim 12, wherein the opening/closing member contacts the edge of the passage opening when in the closed position.

* * * * *